US012371984B2

(12) United States Patent
von Gynz-Rekowski et al.

(10) Patent No.: US 12,371,984 B2
(45) Date of Patent: Jul. 29, 2025

(54) DOWNHOLE SEPARATION SYSTEM AND METHOD

(71) Applicant: Workover Solutions, Inc., Imperial, PA (US)

(72) Inventors: Gunther H H von Gynz-Rekowski, Montgomery, TX (US); Mark Allen Reeves, Houston, TX (US); Russell Wayne Koenig, Conroe, TX (US); Kevin J. Rudy, Tomball, TX (US)

(73) Assignee: Workover Solutions, Inc., Imperial, PA (US)

( * ) Notice: Subject to any disclaimer, the term of this patent is extended or adjusted under 35 U.S.C. 154(b) by 0 days.

(21) Appl. No.: 18/737,518

(22) Filed: Jun. 7, 2024

(65) Prior Publication Data

US 2024/0318534 A1 Sep. 26, 2024

Related U.S. Application Data

(63) Continuation of application No. 18/150,499, filed on Jan. 5, 2023, now Pat. No. 12,037,885.

(51) Int. Cl.
*E21B 43/38* (2006.01)

(52) U.S. Cl.
CPC ..... *E21B 43/385* (2013.01)

(58) Field of Classification Search
CPC ..... E21B 43/385
See application file for complete search history.

(56) References Cited

U.S. PATENT DOCUMENTS

| | | | | |
|---|---|---|---|---|
| 7,243,740 | B2 | 7/2007 | Frith | |
| 2003/0029308 | A1* | 2/2003 | Van Drentham-Susman | E21B 21/103 91/435 |
| 2004/0000433 | A1* | 1/2004 | Hill | E21B 49/08 166/264 |
| 2005/0121233 | A1* | 6/2005 | Frith | E21B 21/002 175/57 |
| 2012/0292047 | A1 | 11/2012 | Knoblock, Jr. et al. | |

(Continued)

OTHER PUBLICATIONS

International Search Report and Written Opinion, mailed Mar. 28, 2024, for corresponding International Patent Application No. PCT/US23/78525.

(Continued)

*Primary Examiner* — Crystal J Lee
(74) *Attorney, Agent, or Firm* — Jones Walker LLP

(57) ABSTRACT

A downhole separation system for use upstream of any tool through which a media flows. The separation system filters at least a portion of any solids from the media flowing through a filter flow path. The separation system flushes at least a portion of the filtered solids through a flush flow path, through a flush outlet on an outer surface of a housing, and into a space surrounding the housing. A screen and an activation mechanism are disposed within a housing inner bore. The filter flow path extends through a plurality of openings in the screen. The activation mechanism is configured to move between a default position in which it directs fluid through the filter flow path and an activated position in which it directs fluid through the flush flow path. Optionally, a spring within the housing inner bore is configured to bias the activation mechanism toward the default position.

13 Claims, 21 Drawing Sheets

(56) References Cited

U.S. PATENT DOCUMENTS

| | | | |
|---|---|---|---|
| 2017/0321806 | A1 | 11/2017 | Collins et al. |
| 2018/0163510 | A1 | 6/2018 | Cleven |
| 2022/0003045 | A1* | 1/2022 | von Gynz-Rekowski ..... E21B 21/103 |
| 2024/0084653 | A1 | 3/2024 | von Gynz-Rekowski et al. |

OTHER PUBLICATIONS

Drilling Tools International, Inc., Drill Pipe Mud Screens, 2022.

* cited by examiner

DOWNHOLE SEPARATION SYSTEM AND METHOD

CROSS-REFERENCE TO RELATED APPLICATIONS

This application is a continuation of and claims priority to U.S. patent application Ser. No. 18/150,499, filed on 5 Jan. 2023, which is incorporated herein by reference.

BACKGROUND

In the process of drilling and maintaining a wellbore, drilling fluid is pumped through drilling motors, such as positive displacement motors, and other drilling and completion equipment, such as friction reduction tools, percussion hammers, and turbines. Most drilling fluids contain solid particles (e.g., weighting material such as barite and hematite, low gravity solids such as bentonite clay, fractured rock and cuttings). Certain portions of the drilling and completion equipment are sensitive to the solid particles within the drilling fluid. For example, certain drilling motors include only metal components, which are not able to flex when drilling fluid containing solid particles flows between the components. Instead, the solid particles often become wedged between two metal components, which causes the drilling motors to prematurely wear out or to stop rotating, thereby disabling the metal-to-metal drilling motor. The power sections of standard drilling motors include nitrile-based elastomeric materials, which will flex to enable solid particles to flow through the drilling motor. However, these elastomeric materials can begin to degrade or fail when the drilling motor is exposed to high temperatures within the wellbore or to oil-based drilling fluids with low aniline point.

In both cases, filters are sometimes positioned upstream of the drilling motors to reduce the amount of solid particles in the drilling fluid before the drilling fluid enters the drilling motors. However, the filters have limited capacity for the collected solid particles and fill after some time. Once the filter reaches capacity, some conventional filters direct the drilling fluid through pathways within the filter to bypass the solid particle capturing section of the filter and thereby retain any solid particles contained therein while allowing unfiltered drilling fluid to reach the downstream drilling motor.

FIGS. 1 and 2 illustrate one example of a conventional filter 2. Fluid flowing through filter 2 is directed to flow through filter surface 4 in order to collect solid particles within filter sleeve 6. When a predefined amount of solid particles are retained within filter sleeve 6, the associated pressure drop causes shear pin 8 to break and release filter sleeve 6, which moves downstream to open bypass ports 10 as shown in FIG. 2. In this position, fluid flow through filter 2 is allowed to continue when filter sleeve 6 is full of solid particles. However, the fluid flowing through the bypass ports 10 is unfiltered, increasing the likelihood of solid particles damaging the drilling motor downstream.

In order to clear the collected solid particles from the filter, conventional filters are usually pulled out from the drill string for cleaning. For example, filter 2 in FIGS. 1 and 2 is required to be pulled out from the drill string in order to remove the collected solid particles before fluid can be filtered again. Removing the filter from the wellbore requires the user to stop drilling operations and results in lost drilling time and increased drilling costs. Alternatively, the collected solid particles may be cleared from the filter by opening the solid particle collecting section of the filter to flush the collected solid particles downstream through a central fluid path with the flow of the drilling fluid to the drilling motor. Flushing the collected solid particles downstream with the drilling fluid results in an increased amount of solid particles flowing through the drilling motor, which increases the likelihood that solid particles will wedge between two metal components in a metal-to-metal drilling motor, thereby increasing the likelihood that certain drilling motors will prematurely wear or stop working altogether.

There is a need for a downhole separation system that filters solid particles from drilling fluid and clears the collected solid particles from the filter without removing the system or the filter from the wellbore and without releasing the collected solid particles downstream.

BRIEF DESCRIPTION OF THE DRAWING VIEWS

DETAILED DESCRIPTION OF SELECTED EMBODIMENTS

Disclosed herein is a separation system that flushes collected solids into the annulus around its outer surface automatically or in response to a signal from the surface of the wellbore. FIGS. 3-23 illustrate an embodiment of the separation system disclosed herein, with many other embodiments within the scope of the claims being readily apparent to skilled artisans after reviewing this disclosure.

Figure 1:
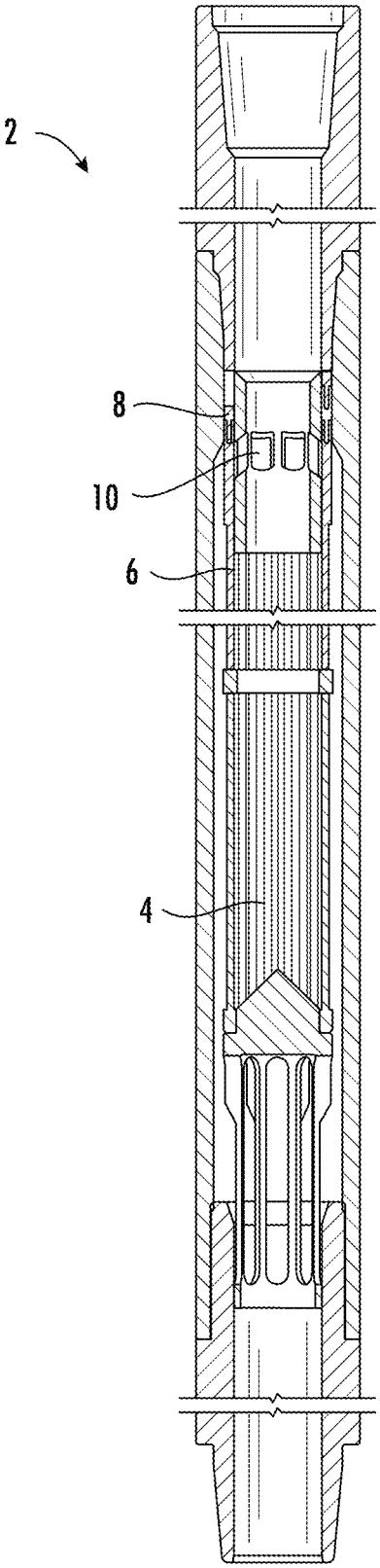
FIG. 1 PRIOR ART
FIG. 1 is a sectional view of a prior art filter device in a filtering position.
Figure 2:
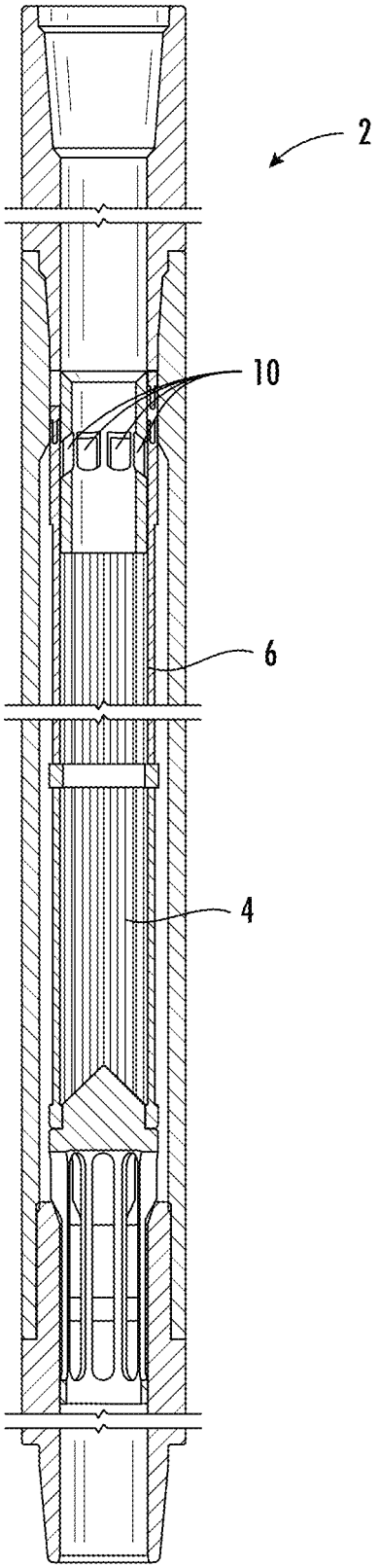
FIG. 2 PRIOR ART
FIG. 2 is a sectional view of the prior art filter device shown in FIG. 1 in a bypass position.
Figure 3:
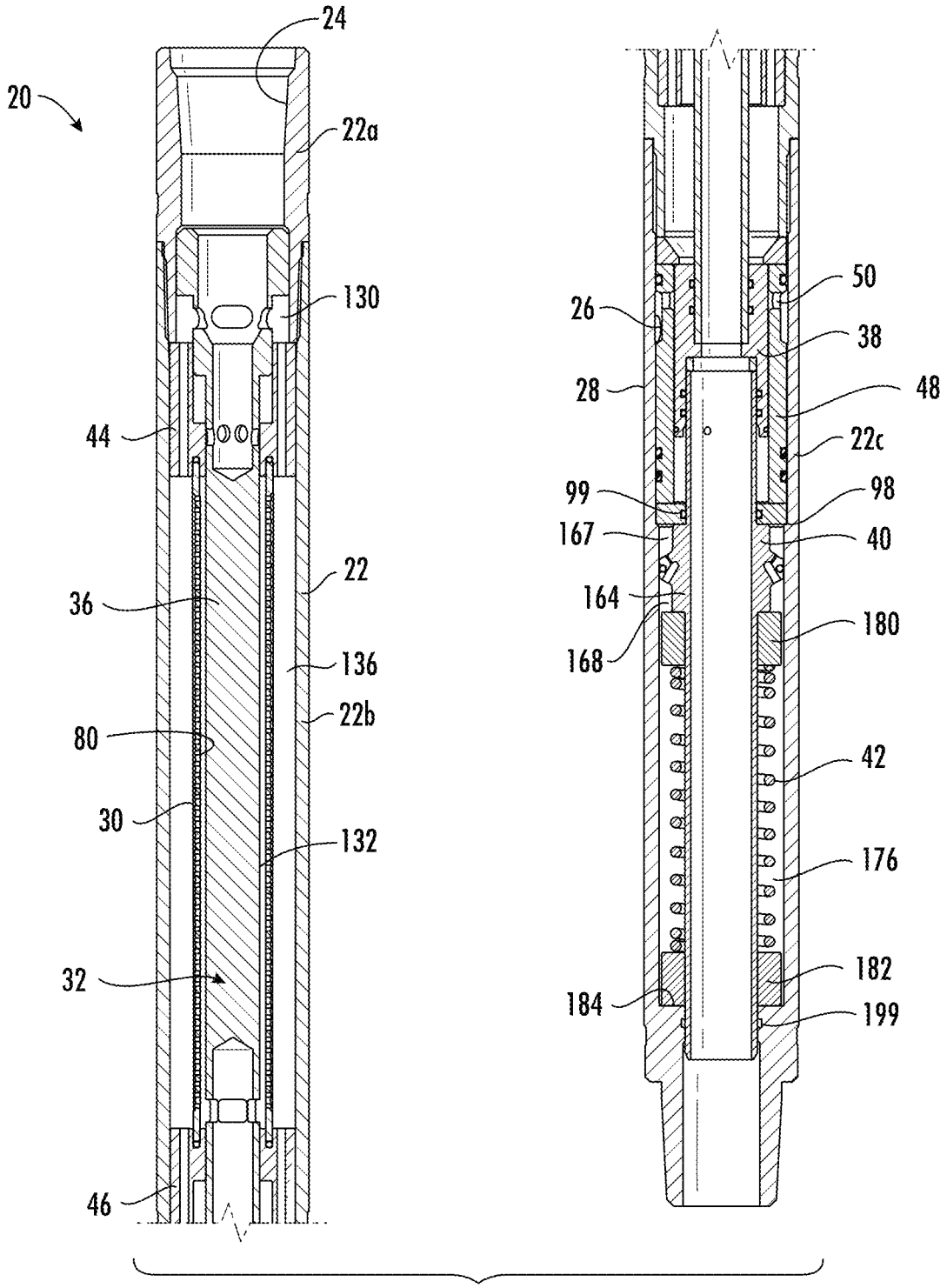
FIG. 3 is a front view of a separation system of the present disclosure in a default position.

FIG. 3 illustrates one embodiment of a downhole separation system in a default filtering position. Downhole separation system 20 may include housing 22, which may include two or more segments, such as housing segments 22*a*, 22*b*, and 22*c*. Each housing segment 22*a*, 22*b*, and 22*c* may have a generally cylindrical shape with housing inner bore 24 extending therethrough. The upper and lower ends of housing 22 may be configured for connection to tubular members in a drill string. Housing 22 may include one or more flush outlets 26 extending radially from the housing inner bore 24 to outer surface 28 of housing 22.

Screen 30 and sliding assembly 32 may be secured within housing inner bore 24. Sliding assembly 32 may be configured to slide within housing inner bore 24. A portion of sliding assembly 32 may be configured to slide within a central bore of screen 30. The sliding assembly is configured to slide between a default position (shown in FIG. 3) and an activated position (shown in FIG. 17) within housing inner bore 24. In the default position, a filter flow path is open and flush outlets 26 are closed. The filter flow path extends through openings in screen 30. In the activated position, a flush flow path leading to flush outlets 26 is open. In certain embodiments, the filter flow path is partially or completely closed in the activated position. In this way, sliding assembly 32 is an activation mechanism of downhole separation system 20.

In the illustrated embodiment, sliding assembly 32 may include mandrel 36, inner valve sleeve 38, and piston 40. Spring 42 disposed within housing inner bore 24 may bias sliding assembly 32 toward the default position, which in the illustrated embodiment is in an upstream direction. Spring 42 may be disposed around a portion of piston 40, which may slide within a central area of spring 42 when piston 40 compresses spring 42. First diverter 44 and second diverter 46 may secure screen 30 within housing inner bore 24. Mandrel 36 may be configured to slide through central bores in first and second diverters 44, 46. Outer valve sleeve 48 may also be secured within housing inner bore 24. Inner valve sleeve 38 may be slidingly disposed within outer valve sleeve 48. In some embodiments, outer valve sleeve 48 defines the upstream limit and the downstream limit of the sliding path for inner valve sleeve 38. In certain embodiments, outer valve sleeve 48 is aligned with flush outlets 26 of housing 22. Outer valve sleeve 48 may include one or more sleeve ports 50.

Figure 4:
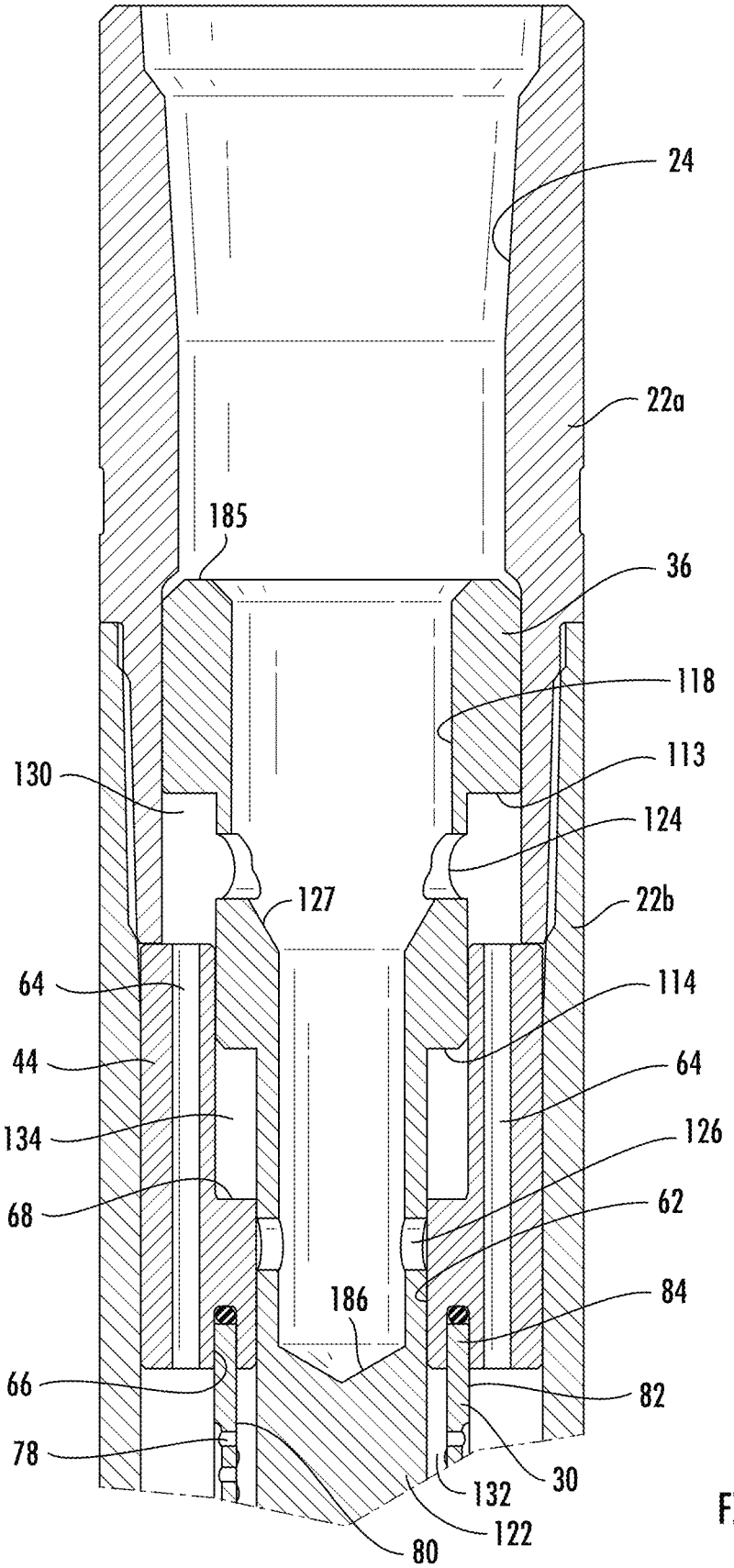
FIG. 4 is a detail sectional view of a portion of the separation system in the default position.
Figure 5:
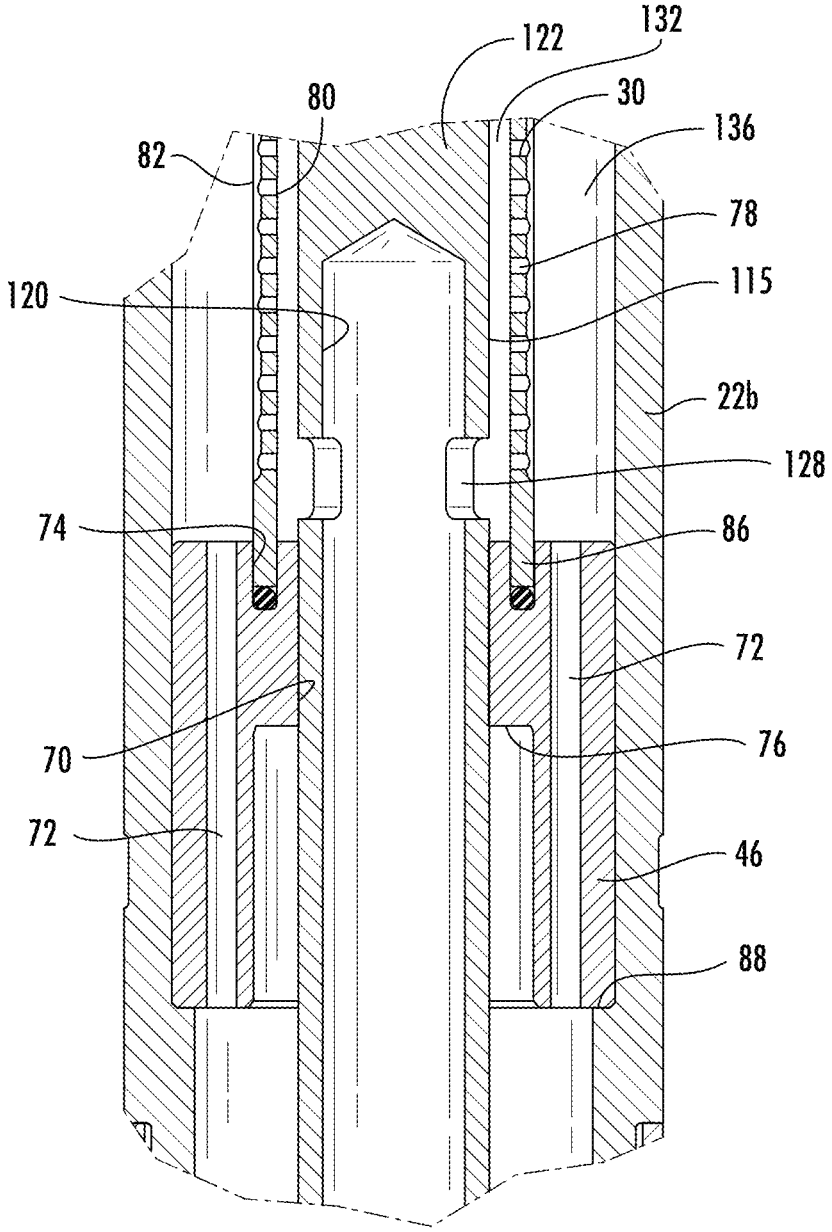
FIG. 5 is another detail sectional view of a portion of the separation system in the default position.

With reference to FIGS. 3-5, first diverter 44 may include central bore 62, a plurality of first diverter passages 64 extending in an axial direction and positioned between central bore 62 and the outer surface of first diverter 44, and screen receptacle 66. Central bore 62 of first diverter 44 may include shoulder 68 providing a larger diameter central bore upstream of shoulder 68 and a smaller diameter central bore downstream of shoulder 68. Similarly, second diverter 46 may include central bore 70, a plurality of second diverter passages 72 extending in an axial direction and positioned between central bore 70 and the outer surface of second diverter 46, and screen receptacle 74. Central bore 70 of second diverter 46 may include shoulder 76 providing a smaller diameter central bore upstream of shoulder 76 and a larger diameter central bore downstream of shoulder 76. Screen 30 may include plurality of openings 78 extending radially from central bore 80 to outer surface 82. Screen 30 is configured to filter a portion of any solids contained in a media (e.g., a liquid or a gas, which may be a drilling media) flowing through the plurality of openings 78. Upstream end 84 of screen 30 may be secured within screen receptacle 66 of first diverter 44, and downstream end 86 of screen 30 may be secured within screen receptacle 74 of second diverter 46.

In some embodiments, the screen assembly formed by screen 30 between first and second diverters 44 and 46 may be secured within housing inner bore 24 in a stationary configuration. For example, in the illustrated embodiment, the screen assembly is secured within housing segment 22*b* with shoulder 88 of housing segment 22*b* and the lower end of housing segment 22*a*. More specifically, a downstream surface of second diverter 46 in the illustrated embodiment engages shoulder 88 of housing segment 22*b* without blocking second diverter passages 72, and an upstream surface of first diverter 44 engages the lower end of housing segment 22*a* without blocking first diverter passages 64.

With reference to FIGS. 3 and 6-8, outer valve sleeve 48 may include central bore 89 configured to allow inner valve sleeve 38 to slide therein. Outer valve sleeve 48 may be secured within housing inner bore 24 in a stationary configuration. For example, in the illustrated embodiment, upstream end 90 of outer valve sleeve 48 engages spacer 92, which engages a lower end of housing segment 22*b*, and downstream end 94 of outer valve sleeve 48 engages valve stop 96, which engages shoulder 98 of housing segment 22*c*. Valve stop 96 may include a recess for housing seal member 99, which may provide a sliding fluid seal between valve stop 96 and piston 40. Housing 22 and outer valve sleeve 48 may be configured to provide flush outlet cavity 100 between outer valve sleeve 48 and housing 22. Flush outlet cavity 100 may be in fluid communication with sleeve ports 50 of outer valve sleeve 48 and flush outlets 26 of housing 22. In some embodiments, such as the illustrated embodiment, flush outlet cavity 100 may be defined by recess 101 in the outer surface of outer valve sleeve 48 and a recess in housing inner bore 24. Alternatively, flush outlet cavity 100 may be defined only by a recess in the outer surface of outer valve sleeve 48 or only by a recess in housing inner bore 24. In certain embodiments, sleeve ports 50 of outer valve sleeve 48 may be offset from flush outlets 26 of housing 22. This offset arrangement may reduce wear by reducing the rate at which a fluid or other media flows through flush outlets 26 and sleeve ports 50. In other embodiments, sleeve ports 50 may be aligned with flush outlets 26. Outer valve sleeve 48 may further include one or more recesses 102 for receiving seal members 104, which may provide a fluid seal between an outer surface of outer valve sleeve 48 and housing inner bore 24.

With reference now to FIGS. 3-6 and 9-10, mandrel 36 may include primary collar 110, secondary collar 112 extending from shoulder 113 to shoulder 114, and outer surface 115 extending from shoulder 114 to downstream end 116. Mandrel 36 may also include upstream central bore 118 and downstream central bore 120 separated by mandrel core 122. One or more mandrel filter ports 124 may extend radially from upstream central bore 118 to the outer surface of secondary collar 112. One or more mandrel flush ports 126 may extend radially from upstream central bore 118 to outer surface 115. Upstream central bore 118 may include tapered surface 127 between mandrel filter ports 124 and mandrel flush ports 126. One or more mandrel lower ports 128 may extend radially from downstream central bore 120 to outer surface 115.

With reference to FIGS. 4 and 5, the outer surface of primary collar 110 of mandrel 36 may engage housing inner bore 24. Portions of mandrel 36 may slide within central bore 62 of first diverter 44, central bore 80 of screen 30, and central bore 70 of second diverter 46. In the default position illustrated in FIGS. 3-6, mandrel 36 may be positioned such that mandrel filter ports 124 is open to filter port cavity 130 defined by housing inner bore 24, shoulder 113 of mandrel 36, and an upper surface of first diverter 44. In this position, mandrel flush ports 126 may be positioned within smaller diameter section of central bore 62 of first diverter 44. Also in this position, mandrel lower ports 128 may be open to screen cavity 132 defined between central bore 80 of screen 30 and outer surface 115 of mandrel 36 and between first and second diverters 44 and 46. Accordingly, in the default position, mandrel filter ports 124 and mandrel lower ports 128 are open, while mandrel flush ports 126 are closed. Mandrel cavity 134 may extend from shoulder 114 of mandrel 36 to shoulder 68 of first diverter 44 between central bore 62 of first diverter 44 and outer surface 115 of mandrel 36. Collection cavity 136 may extend from first diverter 44 to second diverter 46 between housing inner bore 24 and outer surface 82 of screen 30.

Figure 6:
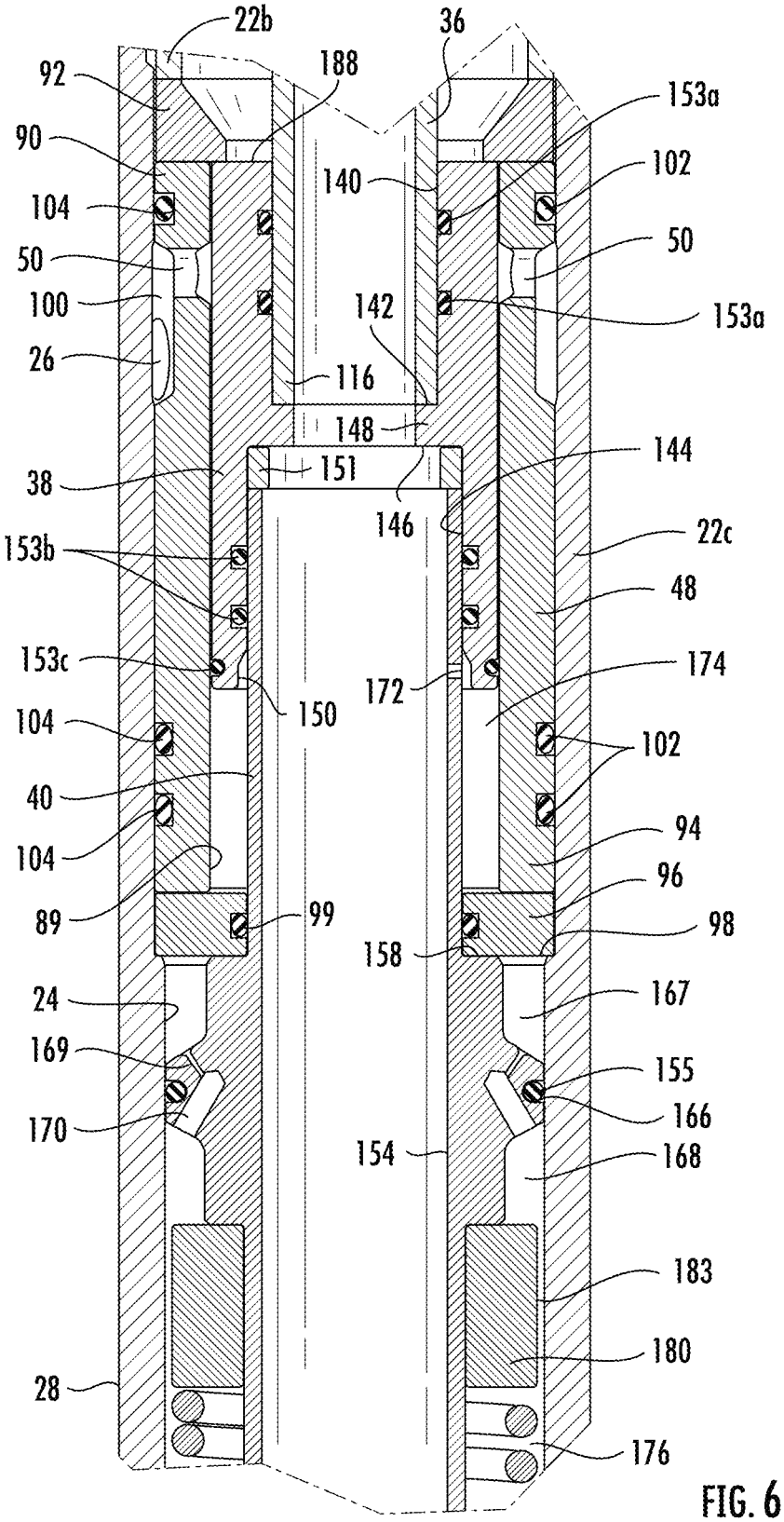
FIG. 6 is another detail sectional view of a portion of the separation system in the default position.
Figure 7:
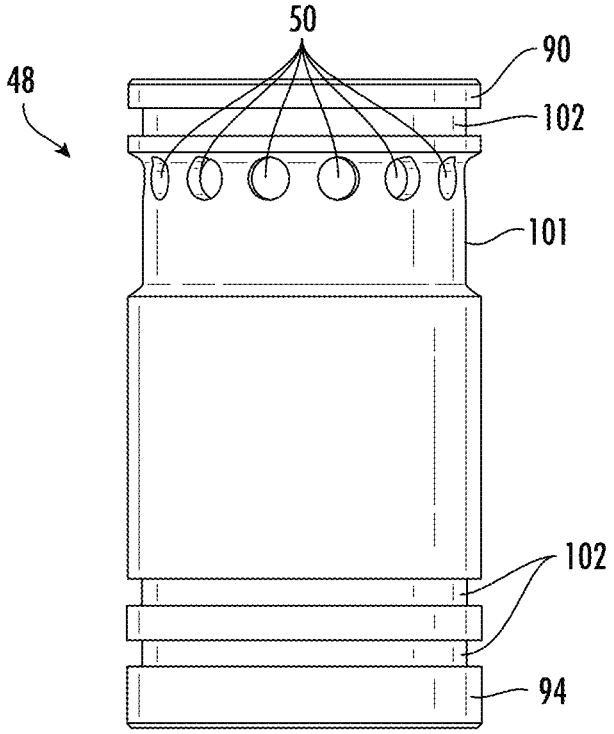
FIG. 7 is a front view of an outer valve sleeve of the separation system.
Figure 8:
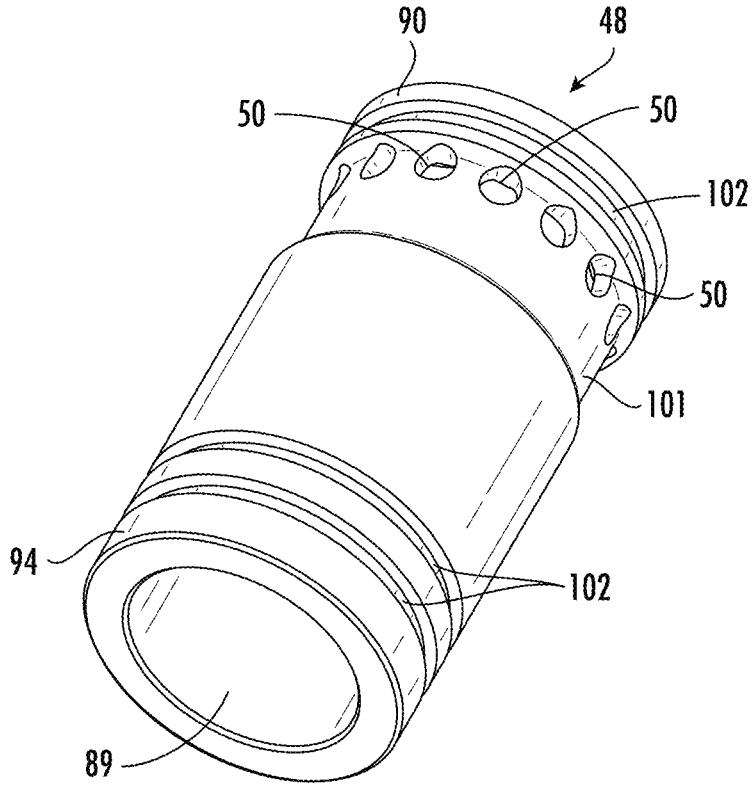
FIG. 8 is a perspective view of the outer valve sleeve.
Figure 9:
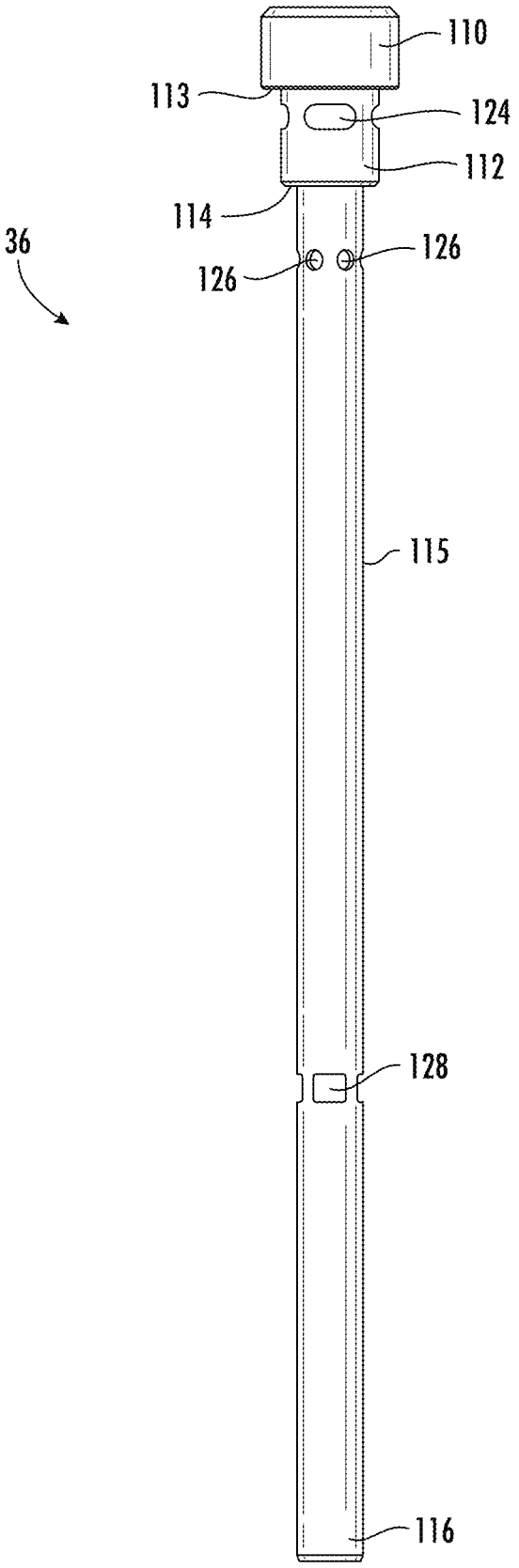
FIG. 9 is a front view of a mandrel of the separation system.
Figure 10:
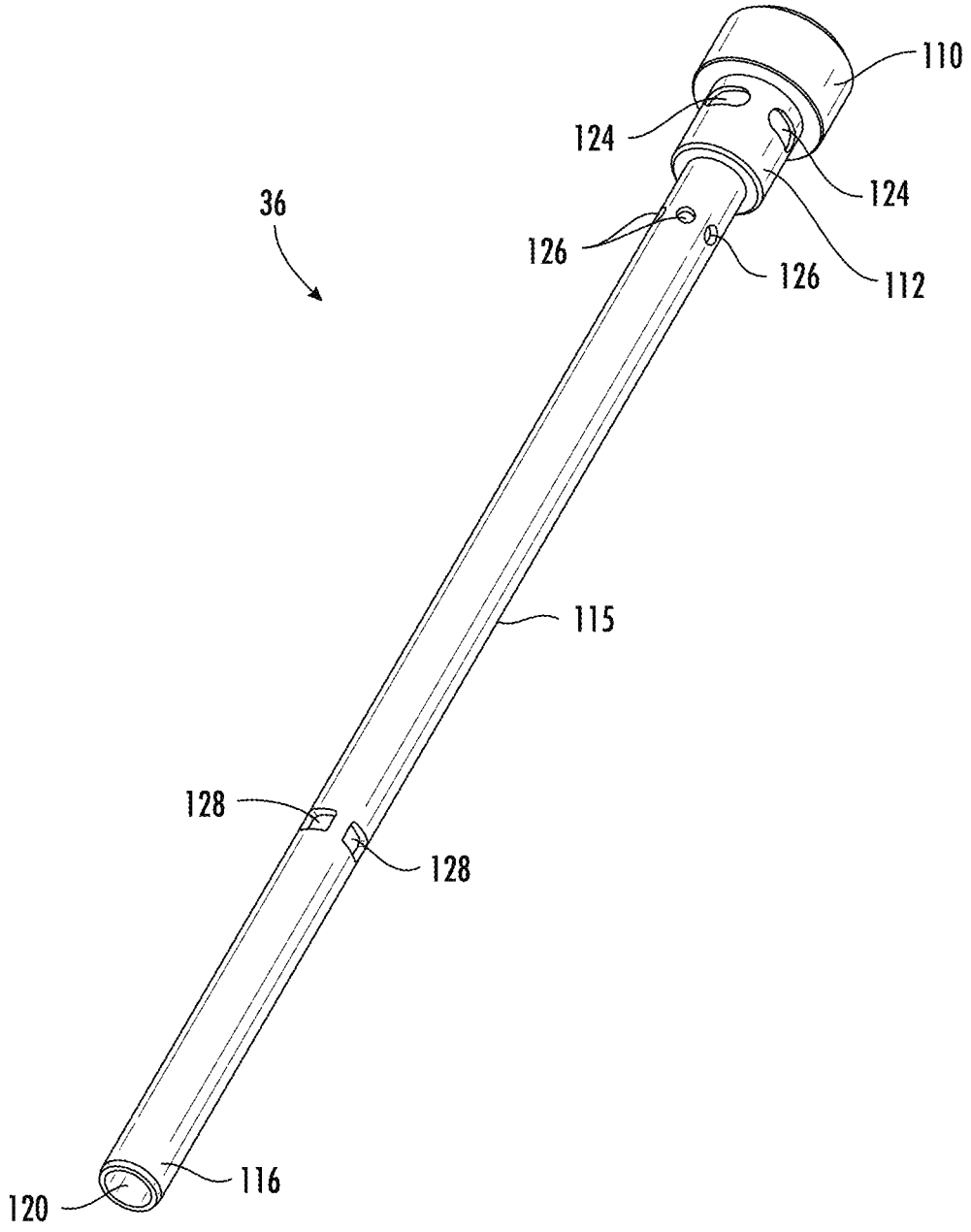
FIG. 10 is a perspective view of the mandrel.
Figure 11:
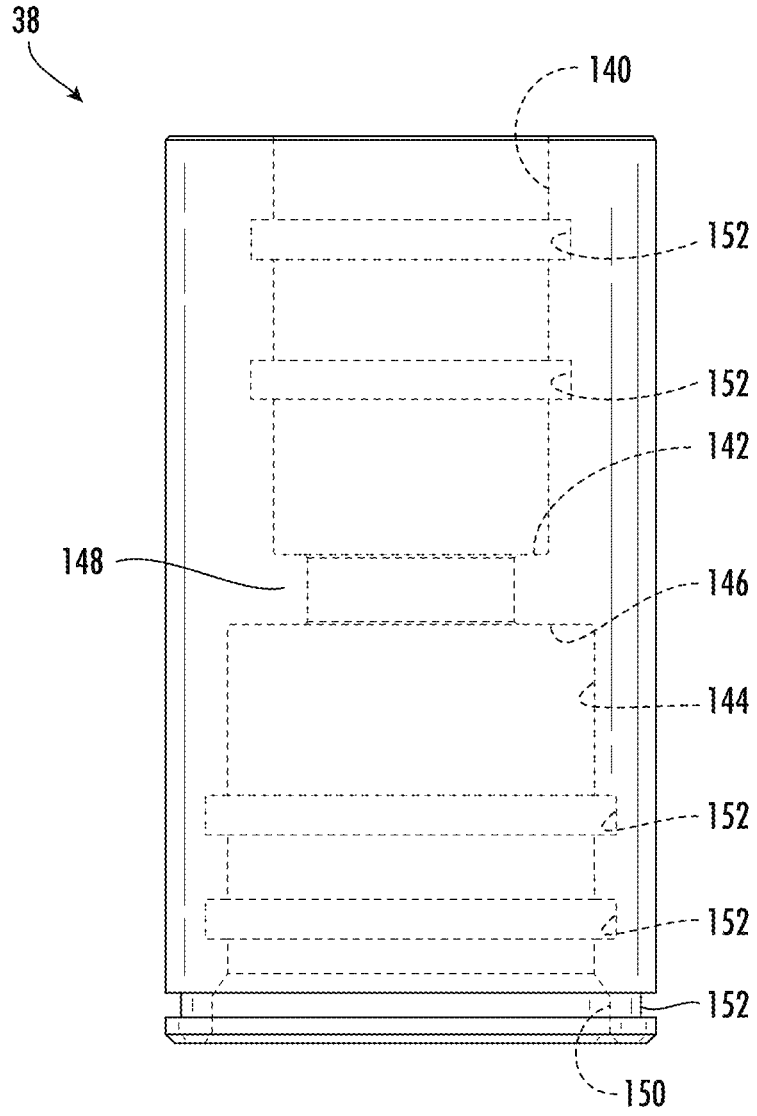
FIG. 11 is a sectional view of an inner valve sleeve of the separation system.

Referring now to FIGS. 6 and 11, inner valve sleeve 38 may be slidingly disposed within central bore 89 of outer valve sleeve 48. In the default position illustrated in FIG. 6, an upstream end of inner valve sleeve 38 may engage a lower end of spacer 92. A central bore of inner valve sleeve 38 may include upstream bore 140 extending from an upstream end of inner valve sleeve 38 to shoulder 142 and downstream bore 144 extending from shoulder 146 to a downstream end of inner valve sleeve 38. Protrusion 148 may be formed between shoulders 142 and 146. The central bore of inner valve sleeve 38 may further include expanded diameter section 150 near its downstream end. Downstream end 116 of mandrel 36 is positioned within upstream bore 140 of inner valve sleeve 38 with downstream end 116 engaging shoulder 142. An upstream end of piston 40 is positioned within downstream bore 144 of inner valve sleeve 38. In certain embodiments, ring 151 may be also be disposed between the upstream end of piston 40 and shoulder 146. In other embodiments, the upstream end of piston 40 engages shoulder 146. Inner valve sleeve 38 may further include one or more recesses 152 in upstream bore 140, in downstream bore 144, and on the outer surface of inner valve sleeve 38 for receiving seal members 153. Seal members 153*a* may provide a fluid seal between upstream bore 140 and the outer surface of mandrel 36. Seal members 153*b* may provide a fluid seal between downstream bore 144 and an outer surface of piston 40. Seal member 153*c* may provide a fluid seal between an outer surface of inner valve sleeve 38 and outer valve sleeve 48.

Figure 12:
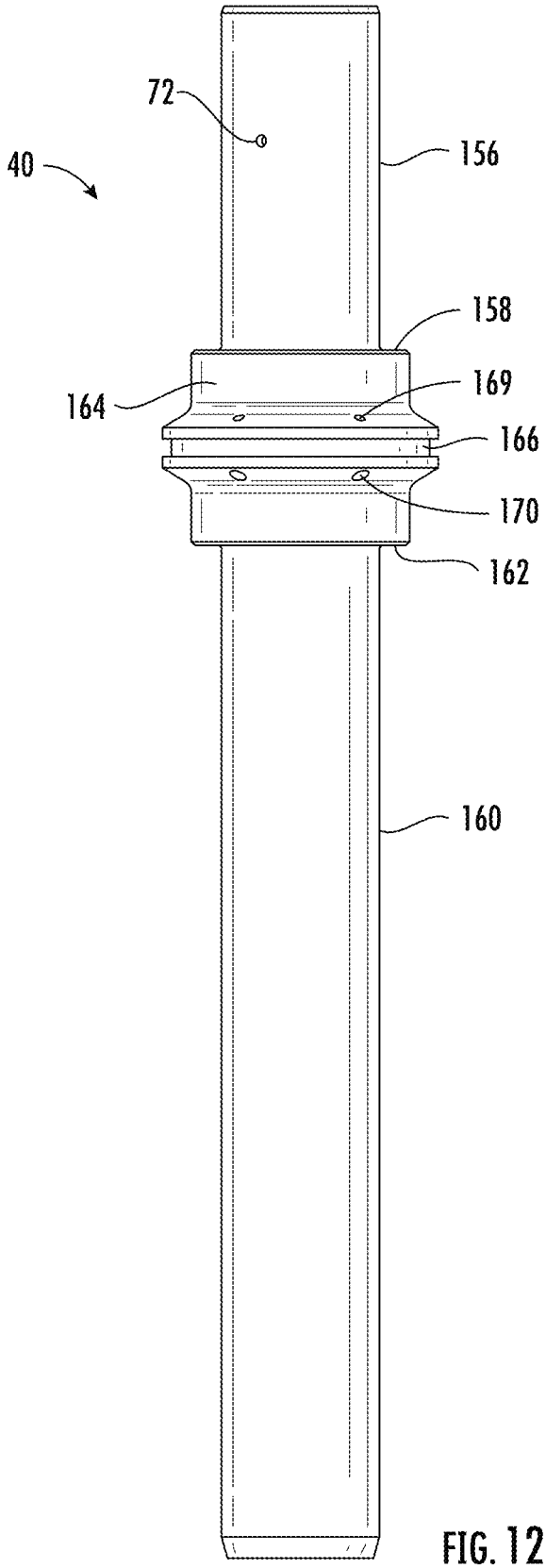
FIG. 12 is a front view of a piston of the separation system.
Figure 13:
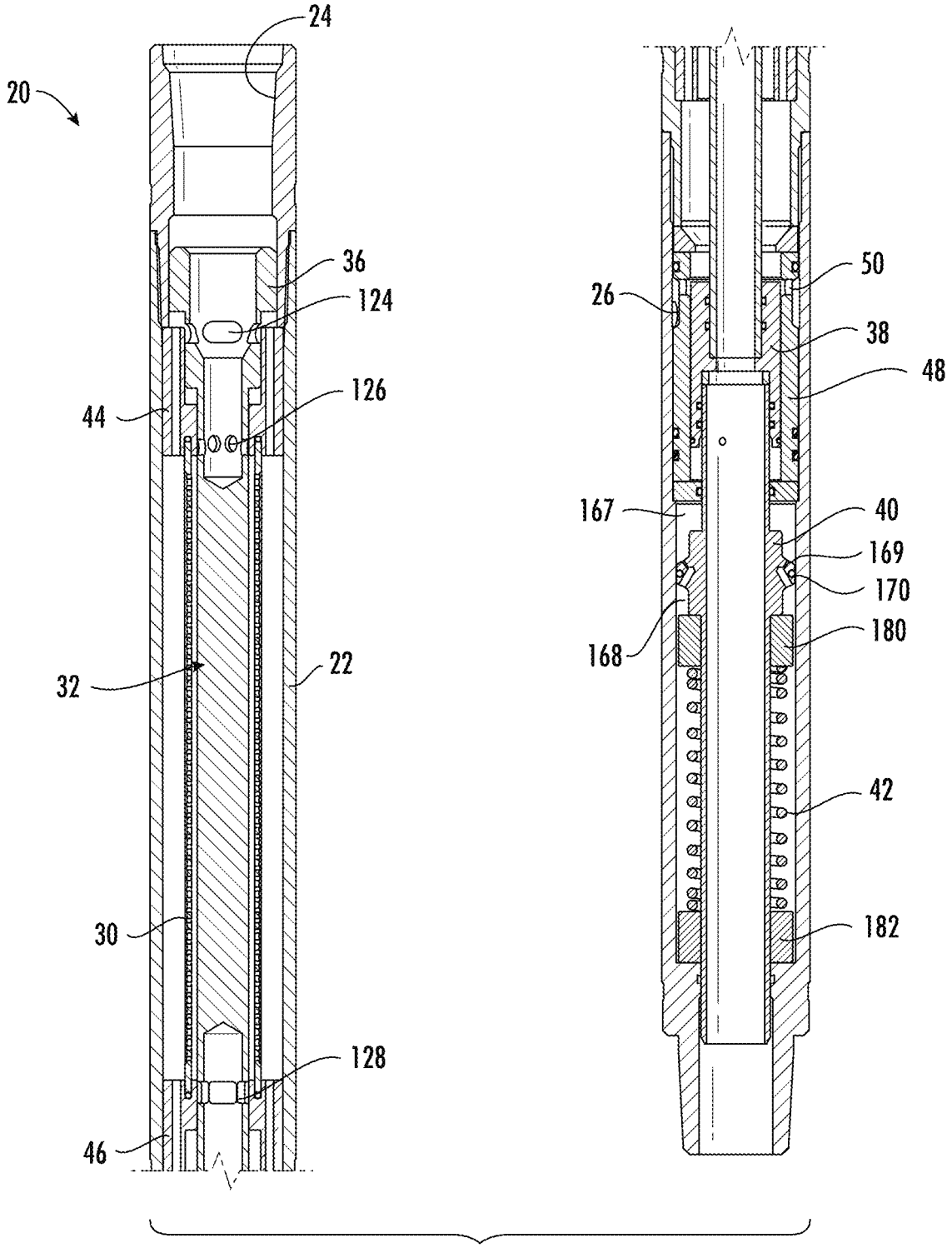
FIG. 13 is a sectional view of the separation device in a partially activated position.
Figure 14:
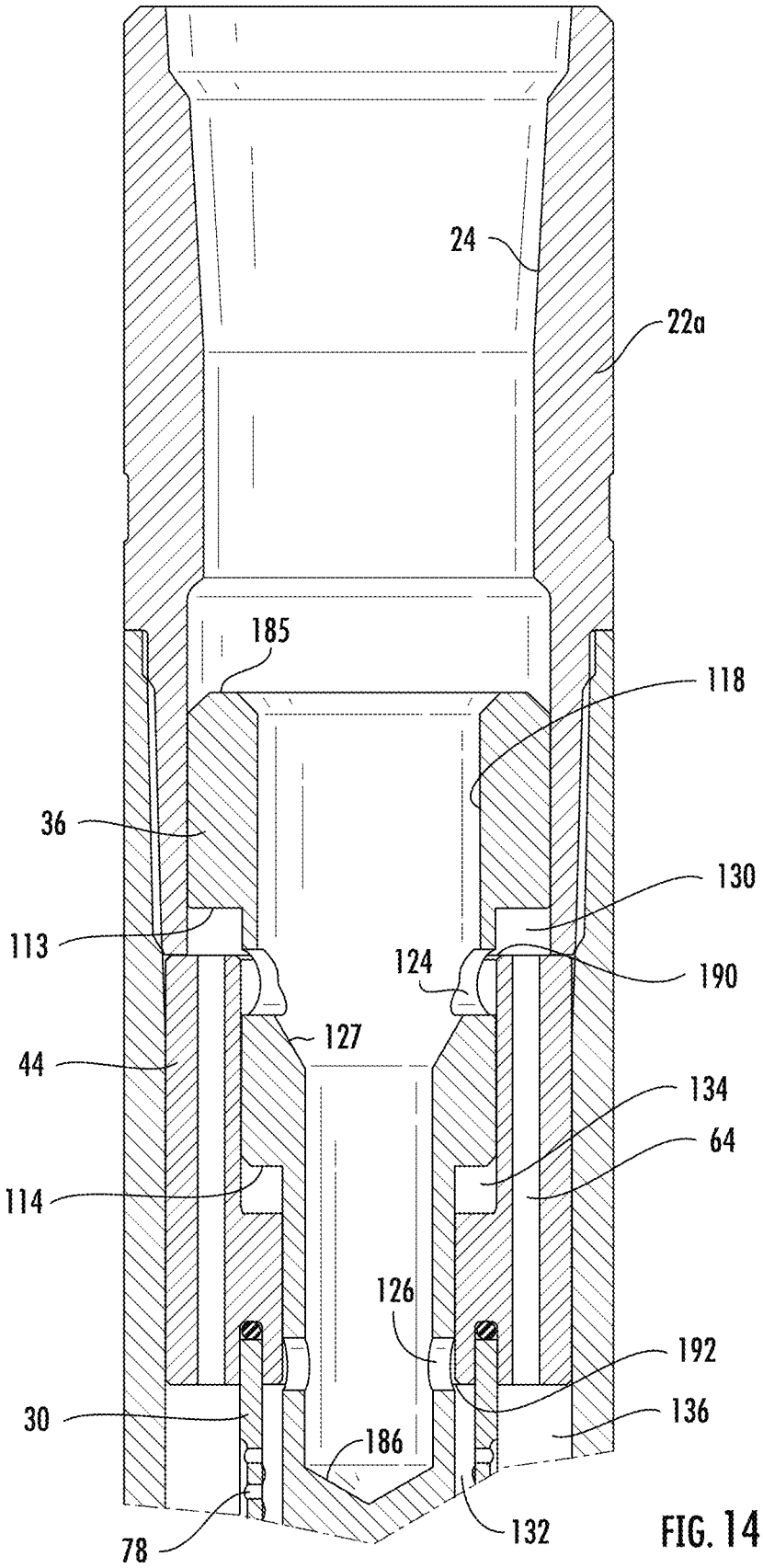
FIG. 14 is a detail sectional view of a portion of the separation system in the partially activated position.
Figure 15:
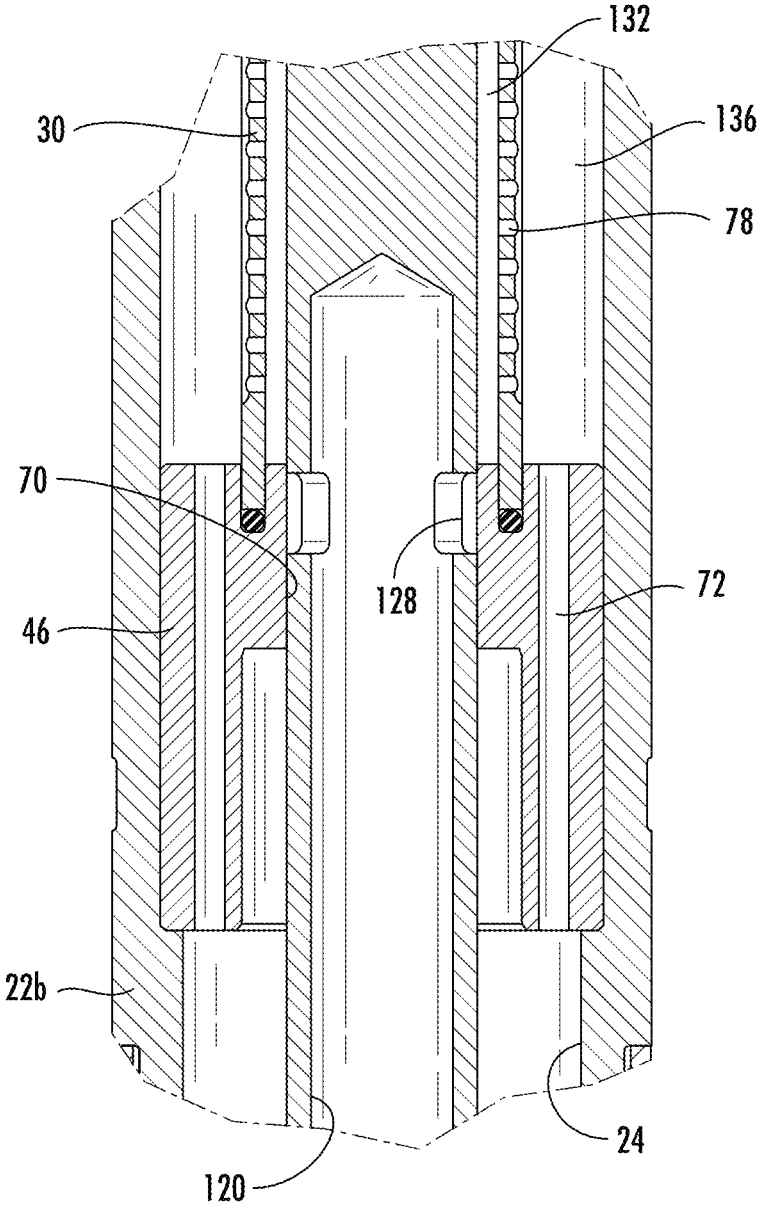
FIG. 15 is another detail sectional view of a portion of the separation system in the partially activated position.
Figure 16:
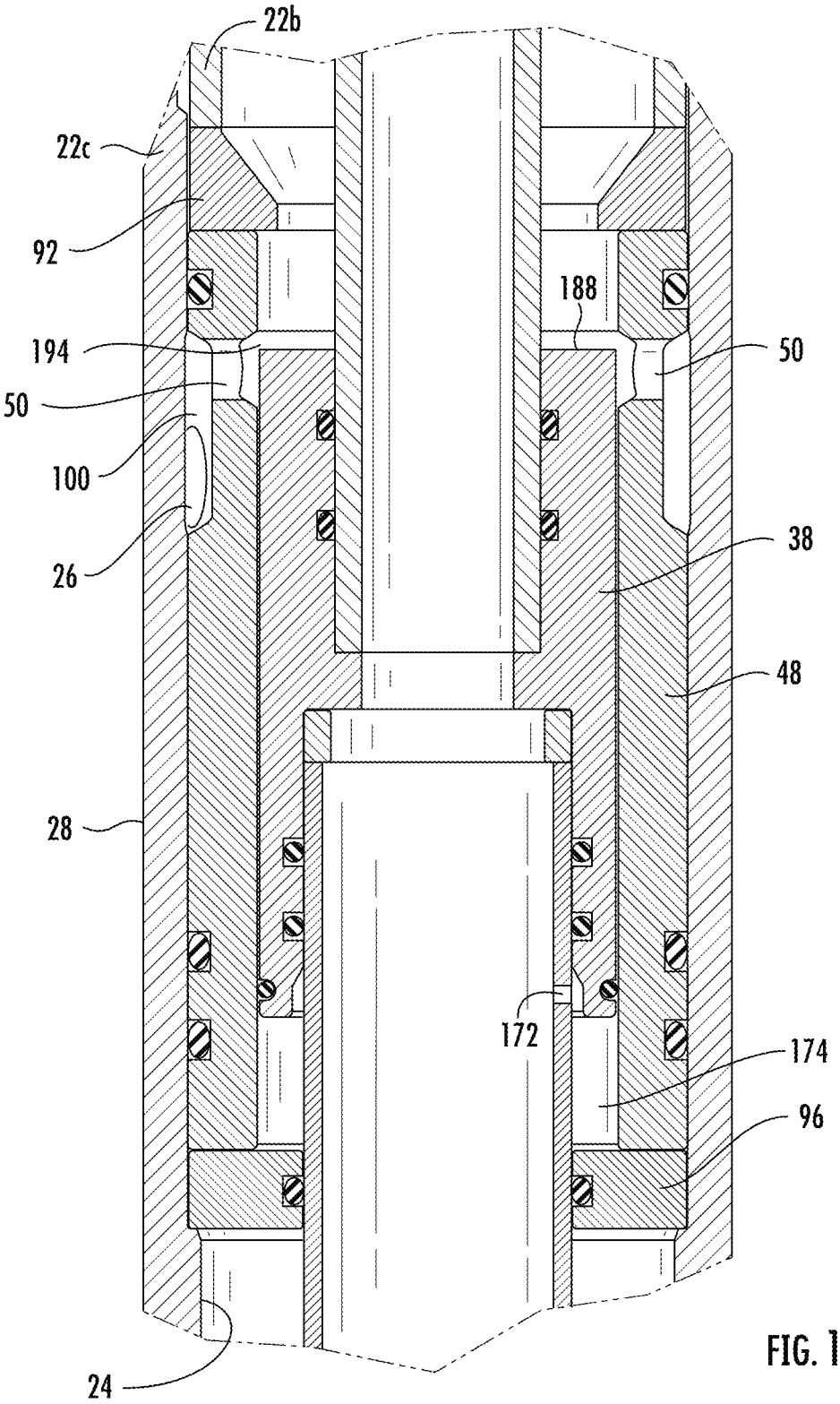
FIG. 16 is another detail sectional view of a portion of the separation system in the partially activated position.
Figure 17:
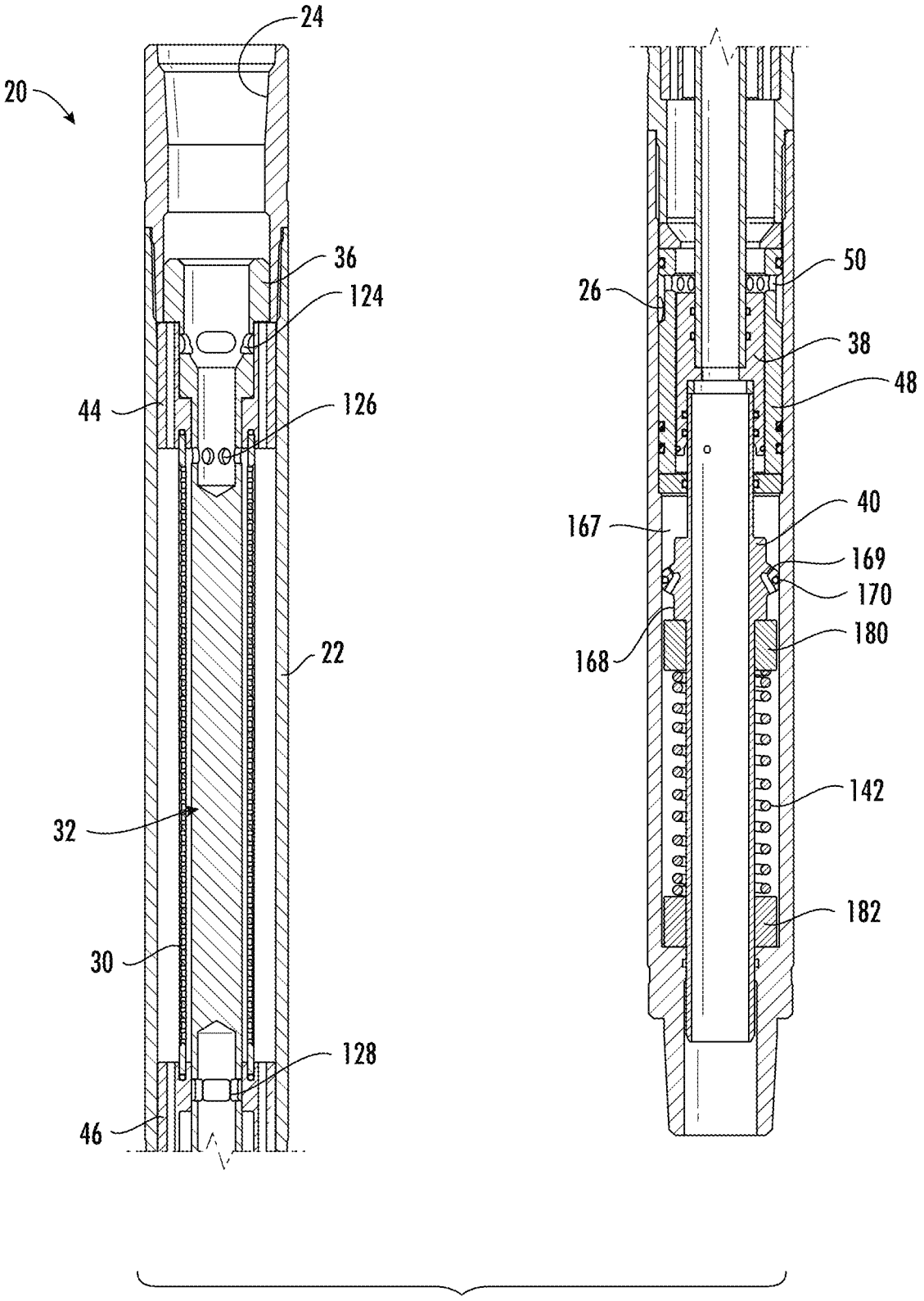
FIG. 17 is a sectional view of the separation device in an activated position.
Figure 18:
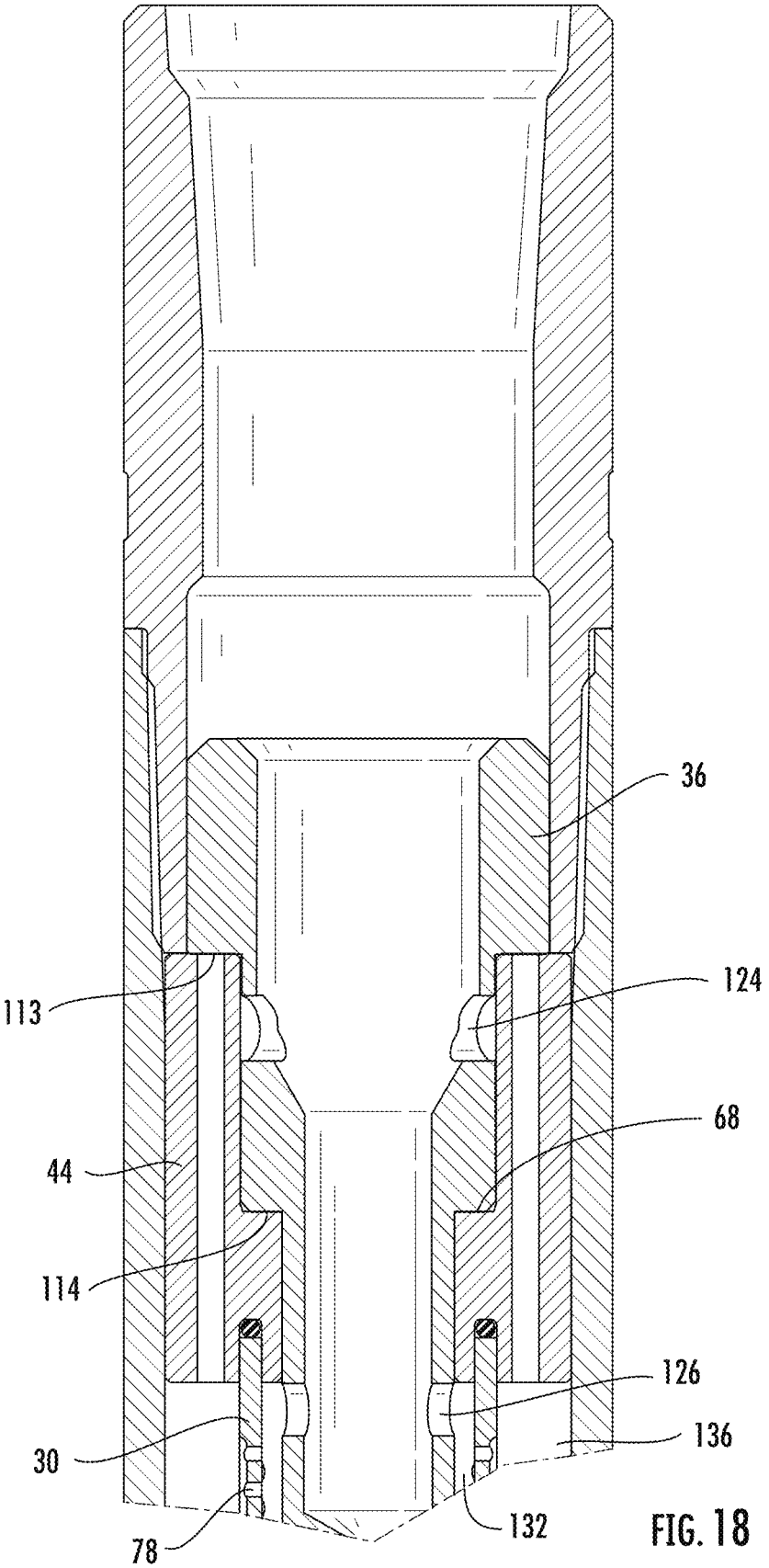
FIG. 18 is a partial detail sectional view of a portion of the separation system in the activated position.
Figure 19:
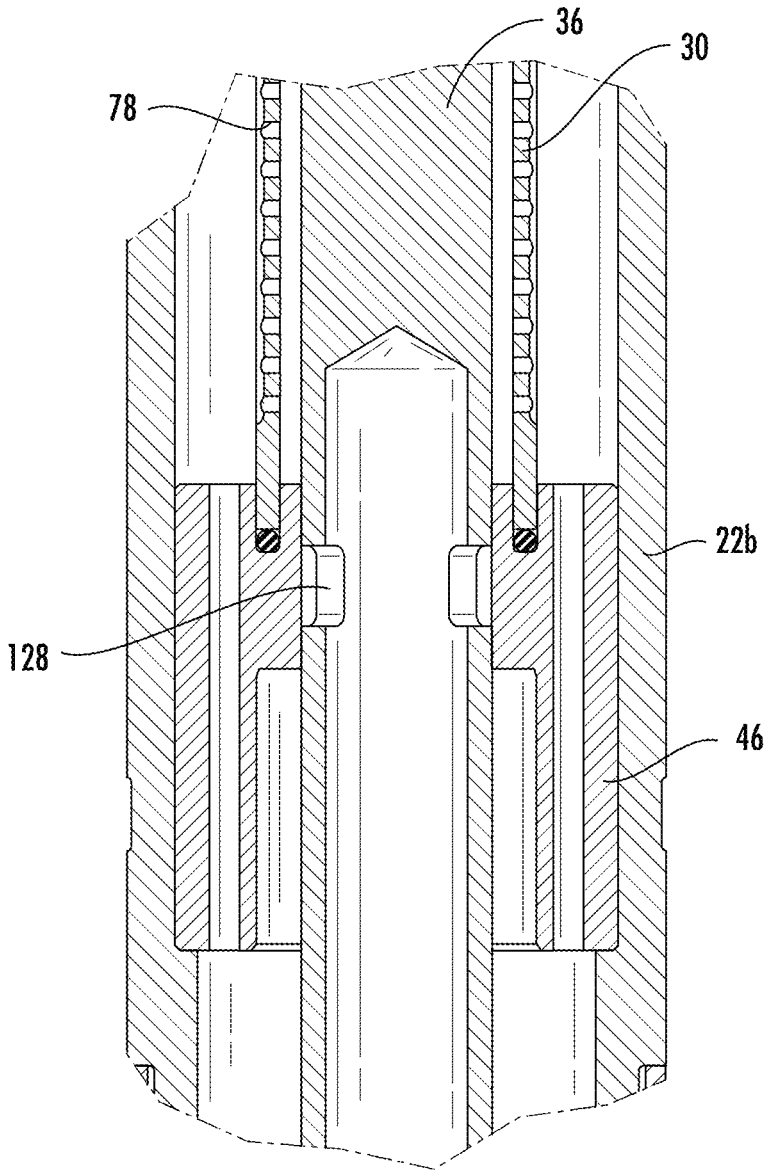
FIG. 19 is another detail sectional view of a portion of the separation system in the activated position.
Figure 20:
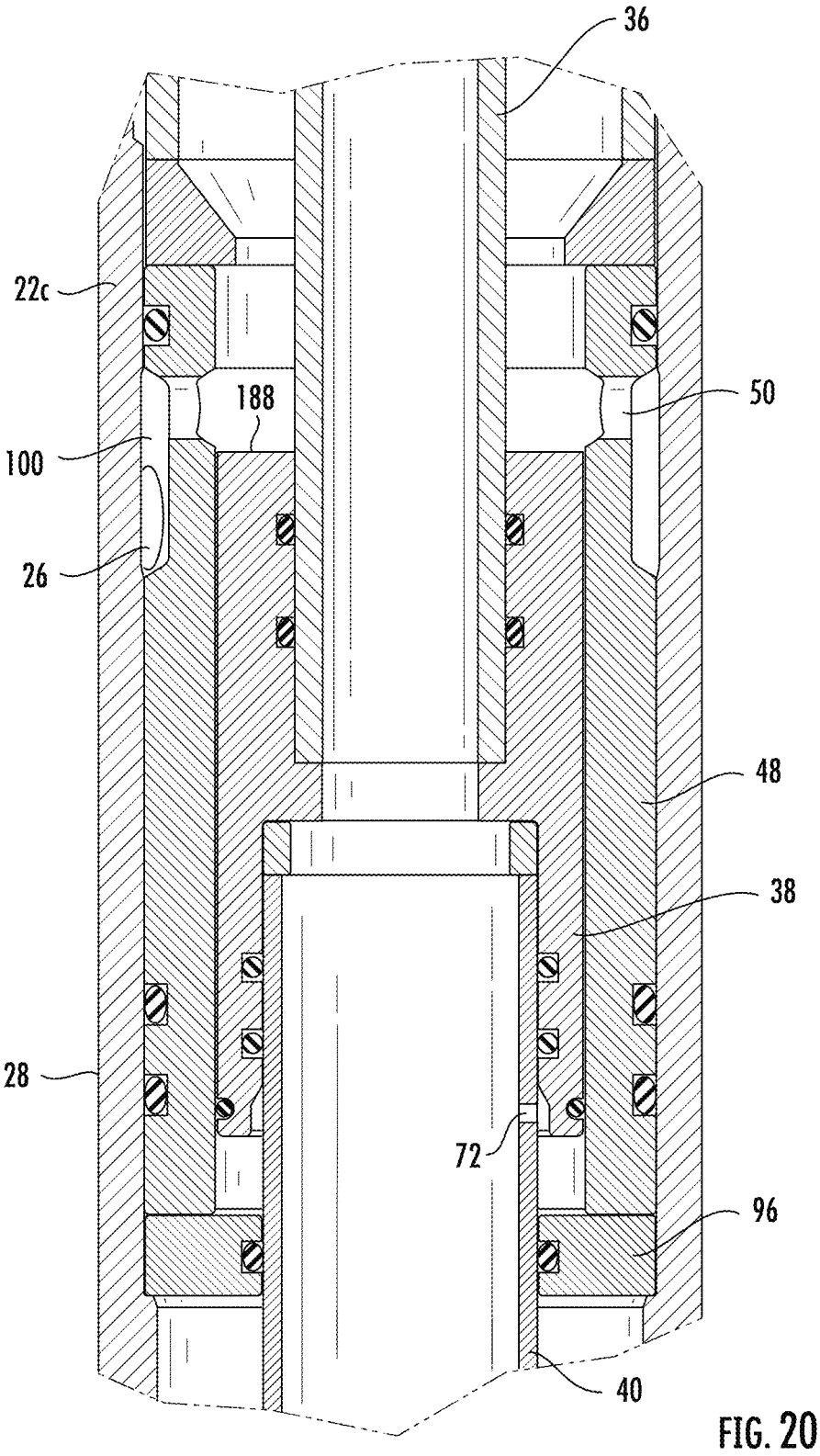
FIG. 20 is another detail sectional view of a portion of the separation system in the activated position.

With reference to FIGS. 3, 6, and 12, piston 40 may include central bore 154, upstream outer surface 156 extending from an upstream end to shoulder 158, and downstream outer surface 160 extending from shoulder 162 to a downstream end. Seal block 164 may form an expanded diameter section between shoulder 158 and shoulder 162. As shown in FIGS. 6 and 12, seal block 164 may include recess 166 configured to receive seal member 155, which may include an O-ring or other sealing element. A portion of the outer surface of seal block 164 may engage housing inner bore 24 in order to provide a fluid seal separating first dampening cavity 167 and second dampening cavity 168 (shown in FIG. 3). One or more fluid passages may extend through the body of seal block 164 and interconnect first and second dampening cavities 167 and 168. For example, one or more first nozzles 169 above seal recess 166 and one or more second nozzles 170 below seal recess 166 may extend inwardly from outer surfaces of seal block 164 (shown in FIG. 12). In some embodiments, each first nozzle 169 is fluidly connected to one of the second nozzles 170 such that a nozzle path is formed from first dampening cavity 167 to second dampening cavity 168 through seal block 164. The nozzle path may include a flow path diameter restriction. In other embodiments, the fluid passages connecting first and second dampening cavities 167 and 168 may include an annular space between seal block 164 and housing inner bore 24.

Piston 40 may further include aperture 172 extending from central bore 154 to upstream outer surface 156. The position of piston 40 within downstream bore 144 of inner valve sleeve 38 may align aperture 172 with expanded diameter section 150 of inner valve sleeve 38. In the default position illustrated in FIG. 6, valve cavity 174 may extend from the downstream end of inner valve sleeve 38 to valve stop 96 between central bore 89 of outer valve sleeve 48 and the upstream outer surface 156 of piston 40. Valve cavity 174 may be fluidly connected to central bore 154 of piston 40 through aperture 172 and expanded diameter section 150. In the default position, shoulder 158 of piston 40 may engage a lower surface of valve stop 96.

Referring again to FIGS. 3 and 6, spring 42 may be positioned in spring cavity 176 defined between housing inner bore 24 and downstream outer surface 160 of piston 40. Spring 42 may be positioned between first spring block 180 and second spring block 182. First spring block 180 may be positioned within housing inner bore 24 between spring 42 and shoulder 162 of piston 40. Flow passage 183 between housing inner bore 24 and first spring block 180 fluidly connects second dampening cavity 168 with spring cavity 176, thereby effectively forming a combined downstream dampening cavity 168/176. Second spring block 182 may be positioned within housing inner bore 24 between spring 42 and shoulder 184 of housing segment 22*c*. Portions of piston 40 may be disposed through central bores in spring blocks 180 and 182. Spring 42 may apply a force in an upstream direction on first spring block 180, which results in an upstream force applied to shoulder 162 of piston 40, shoulder 146 of inner valve sleeve 38, and downstream end 116 of mandrel 36. In this way, spring 42 biases first spring block 180, seal block 164 of piston 40, inner valve sleeve 38, and mandrel 36 in an upstream direction toward the default position illustrated in FIG. 3.

FIGS. 3-6 illustrate downhole separation system 20 in the default position in which a media flowing into housing inner bore 24 at the upper end of housing 22 is directed to flow through a filter flow path within housing 22. The filter flow path extends through the plurality of openings 78 of screen 30 for filtering at least a portion of any solids from the media. In certain embodiments, the filter flow path extends through collection cavity 136 before the plurality of openings 78 of screen 30. For example, the filter flow path may extend from the upper end of housing inner bore 24, into upstream central bore 118, through the one or more mandrel filter ports 124, through filter port cavity 130, through the plurality of first diverter passages 64, through collection cavity 136, through plurality of openings 78 of screen 30, through screen cavity 132, through mandrel lower ports 128 into downstream central bore 120 of mandrel 36, and through central bore 154 of piston 40. As the media flows through the filter flow path, at least a portion of any solids contained in the media are retained within collection cavity 136 when the media flows through the plurality of openings 78 of screen 30. The filtered media continues flowing through the screen cavity 132, through the remainder of the filter flow path, and further downstream, while the collected solids remain in collection cavity 136. In this way, downhole separation system 20 in the default position filters at least a portion of any solids contained in a media flowing through the system, retains the collected solids, and allows the filtered media to continue flowing downstream.

In the default position, a fluid or other media may be contained in mandrel cavity 134 between mandrel 36 and first diverter 44 (shown in FIG. 4), in valve cavity 174 between outer valve sleeve 48 and piston 40 (shown in FIG. 6), in first dampening cavity 167 and second dampening cavity 168 between housing inner bore 24 and seal block 164 of piston 40 (shown in FIG. 6), and in spring cavity 176 between housing inner bore 24 and piston 40 (shown in FIGS. 6 and 3). In some embodiments, media may enter some of these cavities during use. For example, a small amount of a media flowing through housing inner bore 24 will seep through the connection between mandrel 36 and first diverter 44 to enter mandrel cavity 134. A small amount of media flowing through central bore 154 of piston 40 may flow through aperture 172 and expanded diameter section 150 of inner valve sleeve 38 to enter valve cavity 174, which may be fluidly sealed upstream by seal members 153*b* and 153*c* and fluidly sealed downstream by seal member 99 and a compression seal formed by the contact between valve stop 96 and shoulder 98.

In some embodiments, certain fluid cavities of separation system 20 may be charged with a media before use. For example, dampening cavities 167 and 168/176 may be filled with fluid during assembly of separation system 20. The dampening cavities may be filled with fluids that contain a consistent viscosity over a wide temperature range, such as ethylene glycol. In certain embodiments, dampening cavities 167 and 168/176 may fill during use when looser seals are used.

With reference to FIGS. 3 and 6, dampening cavities 167 and 168/176 together with nozzles 169 and 170 may form an independently sealed dampening mechanism of separation system 20. The independent sealed unit may be formed by the upstream fluid seal provided by seal member 99 and the compression seal formed at the interface between valve stop 96 and shoulder 98 and by the downstream fluid seal provided by seal member 199 (shown in FIG. 3). Seal member 199 provides a fluid seal at the sliding interface between a lower outer surface of piston 40 and housing inner bore 24 downstream of shoulder 184. In these embodiments, a fixed amount of fluid initially charged into cavities 167, 168, and 176 may remain in these cavities during use.

Seal member 155 fluidly seals the interface between housing inner bore 24 and seal block 164 of piston 40. Fluid communication between first dampening cavity 167 and the combined downstream dampening cavity 168/176 is provided only through the one or more first nozzles 169 and the one or more second nozzles 170 (shown in FIGS. 6 and 12). First and second nozzles 169 and 170 may be configured to control or limit a flow rate of fluid flow between dampening cavities 167 and 168/176. As sliding assembly 32 moves upstream or downstream, the respective volumes of first dampening cavity 167 and combined downstream dampening cavity 168/176 change. Axial downstream movement of piston 40 pushes a volume of fluid from combined downstream dampening cavity 168/176 through nozzles 170 and 169 and into first dampening cavity 167. The size and number of nozzles 169 and 170 determine the flow rate at which the fluid can move between dampening cavities 167 and 168/176, which in turn controls and reduces the sliding speed or rate at which sliding assembly 32, including piston 40 and mandrel 36, moves or slides axially in each direction. In this way, the dampening mechanism prevents instant opening and closing of bypass port 26. Dampening mechanism also prevents shattering of components of separation system 20 that may be caused by rapid axial movement of sliding assembly 32. The extent to which the dampening mechanism dampens or slows the axial movement of sliding assembly 32 may be adjusted by changing the number and size of nozzles 169 and 170. In one embodiment, first and second nozzles 169 and 170 each include a reduced diameter portion to restrict fluid flow dependent on the sum of the forces acting on sliding assembly 32 from spring 42 and the pressure differential created by fluid flow across sliding assembly 32.

With reference to FIGS. 3-6, a media flowing through separation system 20 in the default position applies a downstream force on an active area of sliding assembly 32, which may include a mandrel active area on mandrel 36 and a valve active area on inner valve sleeve 38. The mandrel active area may be defined by the cross sectional area of the surfaces provided by upstream surface 185 of primary collar 110 of mandrel 36, tapered surface 127 within upstream central bore 118, and end surface 186 of upstream central bore 118 (shown in FIG. 4). The valve active area may be defined by the cross sectional area of the portion of upstream surface 188 of inner valve sleeve 38 that is exposed to a pressure and a downstream force applied by a media flowing through housing inner bore 24. Sliding assembly 32 moves axially relative to the outer valve sleeve 48 and seal member 99, which are both fixed at shoulder 98 relative to housing 22. In the default position, the cumulative upstream facing active area is approximately equal to the cumulative active downstream facing area of the sliding assembly 32, which renders the sliding assembly 32 a balanced (or non-biased) piston assembly. Changes in hydrostatic pressure will not force the sliding assembly 32 to move axially in either direction from the default position. For this reason, separation system 20 is flow rate controlled in the default position. As used herein, "flow rate controlled" means that changes in a flow rate of a media flowing through separation system 20 cause a pressure differential across sliding assembly 32 that creates a downstream force acting on the active area to move sliding assembly 32 from the default position into a partially activated position.

An increase in the flow rate of the media flowing through separation system 20 in the default position applies an increased downstream force on the active area of sliding assembly 32. When the downward force reaches a threshold force value that overcomes the upstream spring force on the sliding assembly 32, the downstream force causes sliding assembly 32 to move in the downstream direction within housing inner bore 24 and compress spring 42. Specifically, mandrel 36 slides in the downstream direction within first and second diverters 44 and 46, within screen 30, and within outer valve sleeve 48; inner valve sleeve 38 slides in the downstream direction within outer valve sleeve 48; and piston 40 slides in the downstream direction within outer valve sleeve 48, valve stop 96, second spring block 182, and housing inner bore 24.

In order for sliding assembly 32 to slide in the downstream direction, a portion of the media contained in certain cavities of separation system 20 must be expelled from those cavities. For example, in order for mandrel 36 to move in the downstream direction, a portion of the fluid in mandrel cavity 134 must be returned to housing inner bore 24 and/or upstream central bore 118 of mandrel 36. Similarly, in order for inner valve sleeve 38 to slide in the downstream direction, a portion of the fluid in valve cavity 174 to be returned to central bore 154 of piston 40. Also, in order for piston 40 to slide in the downstream direction, a portion of the fluid in the combined downstream dampening chamber 168/176 must flow through first and second nozzles 169 and 170 and into first dampening chamber 167. The restricted diameter of nozzles 169 and 170 delay the movement of sliding assembly 32 in response to a change in the flow rate of the media. In this way, the dampening chambers provide a dampening effect on the movement of sliding assembly 32. Sliding assembly 32 slides in response to average flow rates over time as opposed to changes of short duration or quicker fluctuations.

Referring now to FIGS. 13-16, sliding assembly 32 slides in the downstream direction in response to increasing fluid flow rates until reaching a partially activated position illustrated. In certain embodiments, fluid in second dampening chamber 168 must flow into first dampening chamber 167, thereby providing a dampening effect to cause sliding assembly 32 to slide in response to average pressure values over time as opposed to changes of short duration or quicker fluctuations. In this position, lower mandrel ports 128 are disposed within central bore 70 of second diverter 46, which effectively closes lower mandrel ports 128. Also in this position, mandrel filter ports 124 are partially positioned within central bore 62 of first diverter leaving only gap 190 of mandrel filter ports 124 open to filter port cavity 130; a portion of each of the mandrel filter ports 126 are open to screen cavity 132 forming gap 192; and upstream surface 188 of inner valve sleeve 38 is aligned with sleeve ports 50 of outer valve sleeve 48 opening gap 194. In the partially activated position, a flush flow path opens. The flush flow path may extend through screen cavity 132 before plurality of openings 78 of screen 30 and collection cavity 136 to flush the collected solids contained within collection cavity 136 out of separation system 20 through flush outlets 26 into a space surrounding outer surface 28 of housing 22. For example, the flush flow path may extend from the upper end of housing inner bore 24, into upstream central bore 118, through flush mandrel ports 126, through screen cavity 132, through the plurality of openings 78 of screen 30, through collection cavity 136, through the plurality of second diverter passages 72, through housing inner bore 24 below second diverter 46, through spacer 92, through an upstream end of outer valve sleeve 48, through gap 194, through sleeve ports 50, through flush outlet cavity 100, through flush outlets 26, and beyond outer surface 28 of housing 22. As the media flows through the flush flow path, the media may transport the collected solids held within collection cavity 136 through sleeve ports 50 and flush outlets 26 and into a space surrounding the outer surface 28 of housing 22. In some embodiments, the filter flow path is closed in the partially activated position.

With separation system 20 in the partially activated position, a media flowing therethrough may be forced through the flush flow path by the pressure differential between the housing inner bore 24 and the space surrounding outer surface 28 of housing 22. In this position, the downstream force of sliding assembly 32 is created by the pressure differential between the housing inner bore 24 and the space surrounding outer surface 28 of housing 22 across sleeve ports 50 and flush outlets 26. Specifically, the active area in the partially activated position includes the mandrel active area and the valve active area, which may include the total surface area of upstream surface 188 of inner valve sleeve 38 due to the separation from spacer 92. In the partially activated position, the active area may act as a downstream biased piston, which moves in response to the pressure differential between the housing inner bore 24 and an annular space surrounding the outer surface 28 of housing 22. Because sliding assembly 32 is biased in a downstream direction, if the flow rate through housing inner bore 24 decreases, the total downstream force acting on sliding assembly 32 against the upstream spring force may be equal to or greater than the previous downstream force applied from the flow rate alone. For this reason, sliding assembly 32 does not move in an upstream direction to the default position when the flush flow path is opened even if the fluid flow rate drops.

In a wellbore, the pressure in an annulus surrounding housing 22 is lower than the pressure within housing inner bore 24 due to the pressure drop across the bottom hole assembly. In the partially activated position, the pressure inside housing inner bore 24 is greater than the pressure within the annulus. For this reason, separation system 20 is pressure controlled in the partially activated position. "Pressure controlled" means that changes, up or down, in a pressure differential between a pressure of fluid in the housing inner bore 24 of separation system 20 and a pressure in the annulus surrounding housing 22 cause the sliding assembly 32 to slide from the partially activated position to a fully activated position or the default position, respectively. In other words, when partially activated or fully activated, system 20 is controlled by the pressure differential between the pressure in housing inner bore 24 and an annulus surrounding housing 22. If fluid flow slows while the pressure differential across separation system 20 and the annulus remains lower, sliding assembly 32 will not return to the default position even with the reduction of fluid flow. When fluid flow is stopped, internal fluid pressure may bleed off through flush flow path until the force acting on the active area is less than the upstream force from spring 42 biasing the sliding assembly 32 in the upstream direction.

With reference to FIGS. 17-20, increasing pressure differentials between housing inner bore 24 and an annulus surrounding housing 22 cause sliding assembly 32 to continue to slide in the downstream direction until reaching a fully activated position illustrated. In this position, shoulders 113 and 114 of mandrel 36 engage an upper end and shoulder 68 of first diverter 44, respectively. Filter mandrel ports 124 may be completely disposed within the central bore of first diverter 44 and mandrel lower ports 128 may remain completely disposed within the central bore of second diverter 46 in order to close filter mandrel ports 124 and to retain mandrel lower ports 128 in the closed position. In the fully activated position, flush mandrel ports 126 may be completely disposed within screen cavity 132 to fully open the flush flow path. In the fully activated position, a media flowing through the system 20 may flush collected solids from collection cavity 136 and out through sleeve ports 50 and flush outlets 26.

Separation system 20 is pressure controlled in the fully activated position. If fluid flow slows while the pressure differential between housing inner bore 24 and the annulus is reduced slightly, sliding assembly 32 will not slide in the upstream direction towards the default position. In order to cause sliding assembly 32 to slide in the upstream direction and return to the default position shown in FIGS. 3-6, the pressure difference between housing inner bore 24 and the annulus may be reduced. This may be accomplished by reducing the pressure in the housing inner bore 24, by increasing the pressure in the annulus, or by turning off the fluid pump and allowing the pressure to equalize across the flush fluid path. Once sliding assembly 32 slides in the upstream direction past the partially activated position, the activated area reverts back to the flow controlled valve. Without sufficient flow rate, sliding assembly 32 continues to move to the default position shown in FIGS. 3-6.

Because separation system 20 is flow rate controlled in the default position, it is automatically activated when a fluid flow rate exceeds a predetermined force threshold value. Separation system 20 is pressure controlled in the partially activated position and the fully activated position. Accordingly, after beginning to flush the media and any collected solids to the annulus, separation system 20 is not unintentionally closed by flow rate changes. Separation system 20 is transferred to the default position only in response to a predefined pressure change created at a surface of a wellbore. Additionally, the dampening effect provided by nozzles 169 and 170 and dampening chambers 167 and 168 prevents separation system 20 from being unintentionally activated or deactivated due to pressure pulses, vibration, bit plugging, or motor stalling. In one embodiment, the dampening effect may effectively require a flow rate change or pressure change to be maintained for a specified time (e.g., 30-45 seconds) before the separation system 20 changes positions.

Separation system 20 is configured to reach the partially activated position (in FIGS. 13-16) at a predefined flow rate and to reach the fully activated position (in FIGS. 17-20) at a predefined pressure differential. In a further embodiment, the predefined flow rate and predefined pressure differential may be adjusted, such as by replacing spring 42 with a spring having a different compression strength or a different length or by replacing ring 151 with a different inner diameter.

Figure 21:
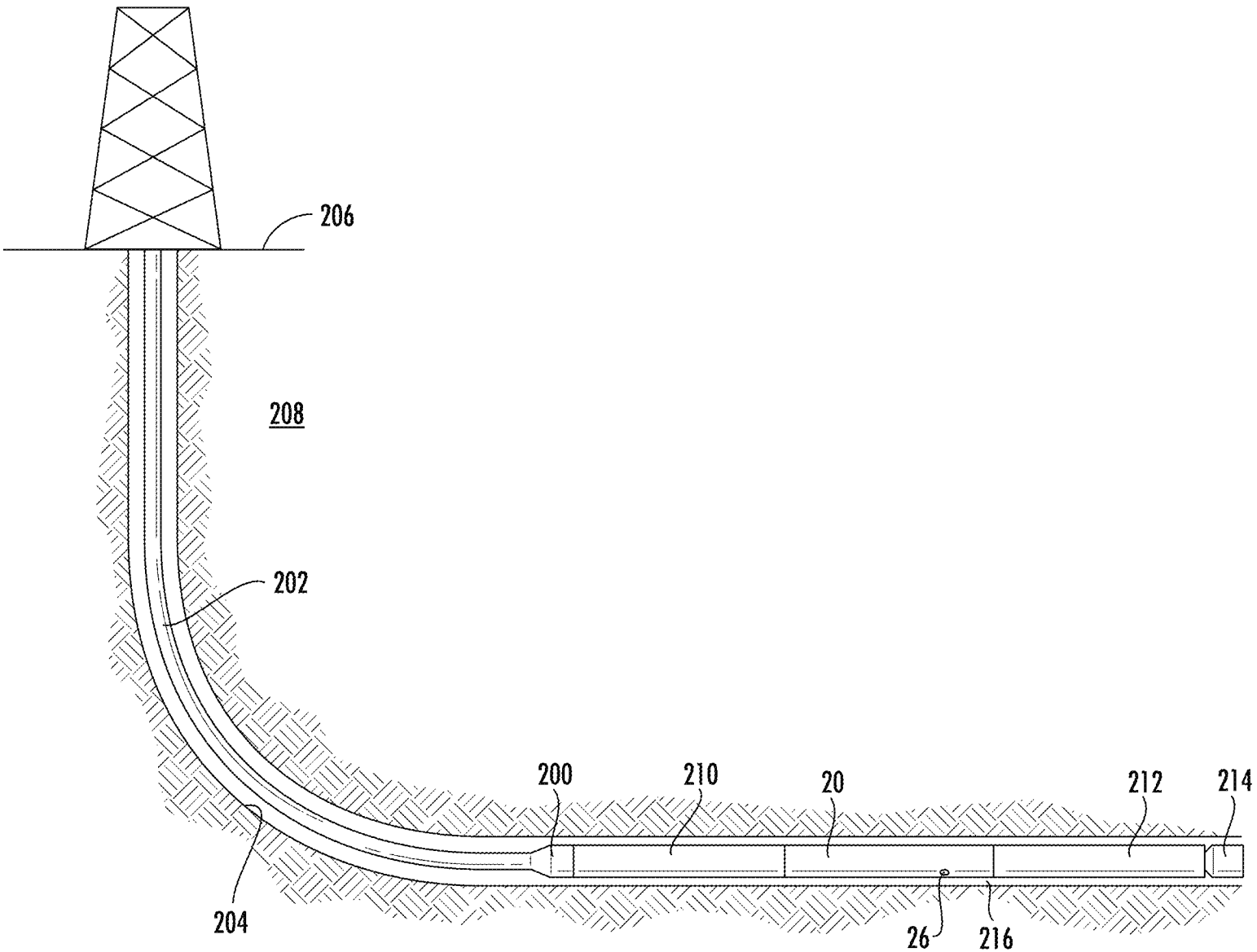
FIG. 21 is a schematic view of an embodiment of the downhole separation system positioned in a subterranean wellbore with a coiled tubing string.

Referring now to FIG. 21, downstream separation system 20 may be secured to coiled tubing connector 200 at a distal end of coiled tubing string 202 for use in drilling wellbore 204 extending below surface 206 through subterranean formation 208. In some embodiments, MWD tool 210 may be positioned between coiled tubing connector 200 and separation system 20, with driving mechanism 212 (e.g., a drilling motor) and drill bit or mill 214 positioned downstream. A drilling media may be pumped through coiled tubing string 202 and coiled tubing connector 200. As the drilling media flows through separation system 20 in the default position (i.e., the filter mode), all or a portion of the solid particles within the drilling media may be removed and collected within collection cavity 136. The filtered or cleaned drilling media (i.e., the remaining liquid or gas components) flow downstream through the driving mechanism 212 and drill bit 214. In some embodiments, separation system 22 may be activated in response to an increase in a flow rate of the drilling media. When the separation system 22 reaches a predefined threshold flow rate value, sliding assembly 32 of separation system 22 may be placed into the fully activated position or the partially activated position. In this partially activated position or fully activated position (i.e., the flush mode), separation system 22 uses the flow of the drilling media to flush the collected solid particles out of separation system through flush outlet 26 and into annulus 216 between separation system 22 and the formation 208. Once the upstream fluid pressure drops below a predefined deactivation value, the separation system 20 may automatically move back into the default position so that the solid particles are again collected from the drilling media flowing through separation system 20 and the cleaned drilling media then flows through driving mechanism. The separation device 20 may also be placed in the filter mode or in the flush mode in response to a signal received from surface 206 of the wellbore 204. Such signals may be, but not limited to, a sequence of pressure pulses (mud weight changes), flow rate changes, drill pipe rotation changes or the use of RFID (Radio-frequency identification) technology.

Figure 22:
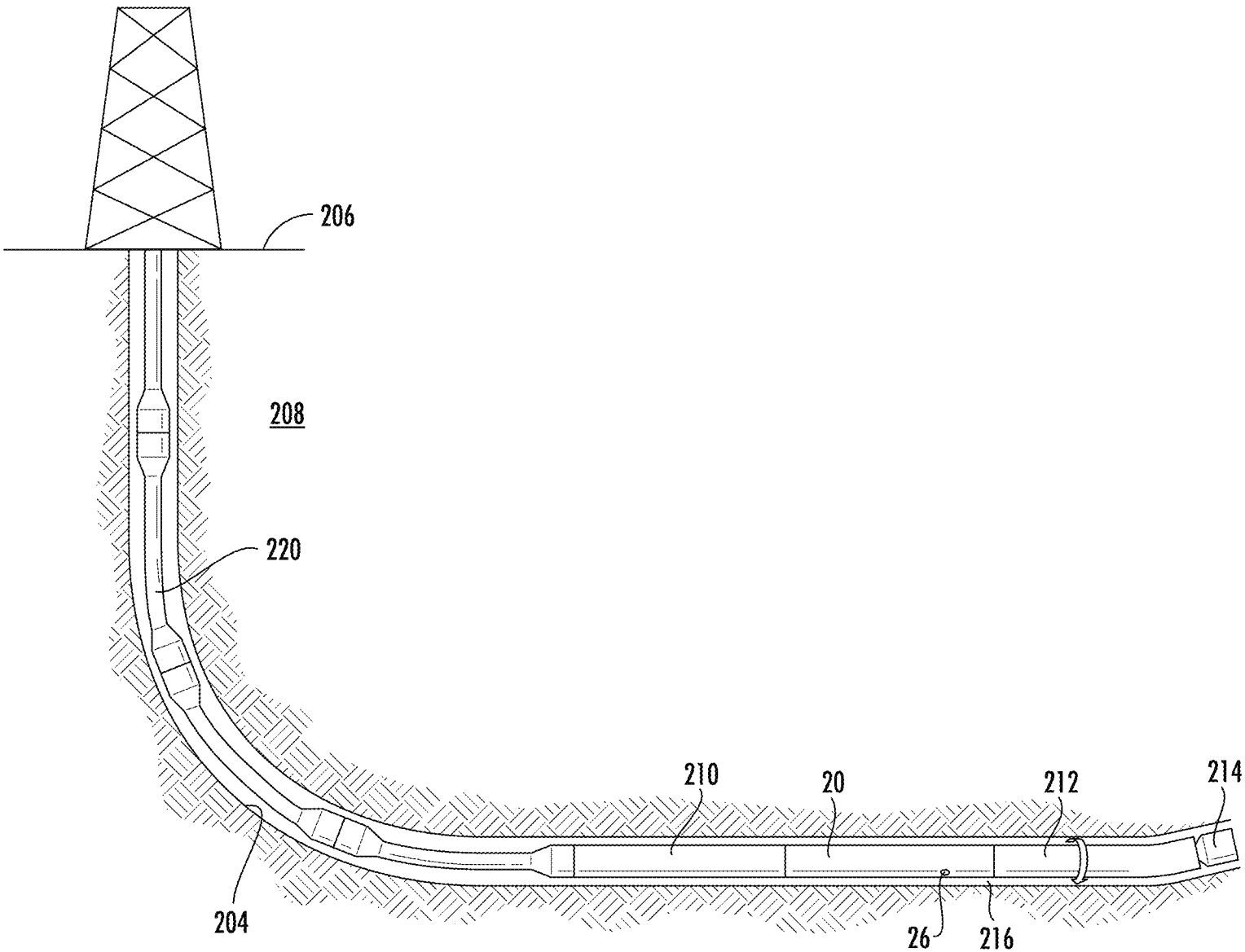
FIG. 22 is a schematic view of an embodiment of the downhole separation system positioned in a subterranean wellbore with a tubular string.

With reference to FIG. 22, separation system 20 may be secured to a distal end of a drill string 220 for use in drilling wellbore 204. In this embodiment, MWD tool 210 may be positioned upstream of separation system 20, with driving mechanism 212 and drill bit 214 positioned downstream. Driving mechanism 212 may include a bent housing drilling motor. Drilling media flowing through drill string 220 may flow through separation system 20 before reaching driving mechanism 212 and drill bit 214. Separation system 20 in the default position (i.e., the filter mode) may remove a portion or all of the solid particles in the drilling media. In the same way as in FIG. 21, when the collected solid particles in separation system 20 cause the upstream fluid pressure to reach a predefined activation value, separation system 20 is activated and placed in the fully activated position (i.e., the flush mode). When activated, the fluid flowing through separation system 20 flushes the collected solids through flush outlet 26 and into annulus 216 between separation system 20 and the formation 208. After deactivation, the fluid flowing through separation system 20 in the default position is again cleaned before flowing into driving mechanism 212.

Alternatively, separation system used as illustrated in FIGS. 21 and 22 may be activated and switched into the flush mode in response to a signal from the surface. For example, the signal may be a pressure pulse, an electric signal, a magnetic signal, a mechanical signal (rotational speed change, weight-on-bit (WOB) change, axial movement of drill pipe, etc.), or any other type of signal capable of being detected within wellbore 204.

Figure 23:
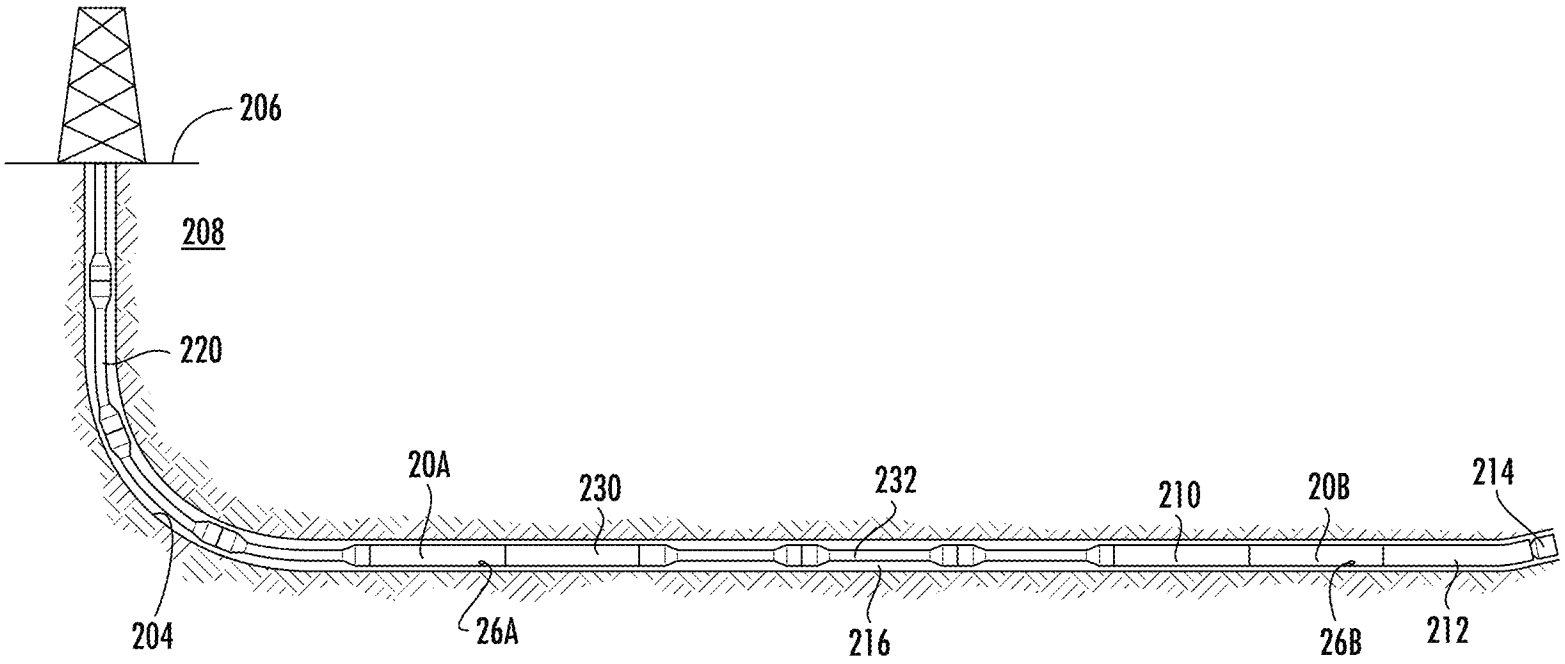
FIG. 23 is a schematic view of an upstream separation system and a downstream separation system positioned within the same tubular string in a subterranean wellbore.

As shown in FIG. 23, two or more separation systems 20 may be used in a drill string 220 when drilling wellbore 204. Upstream separation system 20A may be secured to a downstream end of drill string 220 in connection with upstream tool 230. Tubular string 232 may be secured between upstream tool 230 and downstream separation system 20B. Driving mechanism 212 and drill bit 214 may be secured below downstream separation system 20B. Driving mechanism 212 may be configured to drive drill bit 214, while upstream tool 230 may be configured to generate a vibration, activate a valve or any actuation device, or power an electrical generator. For example, driving mechanism 212 may include a positive displacement motor (e.g., a vane motor or a Moyno motor), a turbine, a percussion motor, or a hammer, while upstream tool 230 may include a turbine, a friction reduction tool, or a vibration generating tool, or any other tool that benefits from use of cleaned drilling fluid. Upstream separation system 20A may remove solid particles from a drilling fluid pumped through drill string 220 such that a cleaned or filtered drilling fluid flows into upstream tool 230. Downstream separation system 20B may remove solid particles from the drilling fluid such that a cleaned or filtered drilling fluid flows into driving mechanism 212. When either or both of the separation systems 20A and/or 20B are activated (either automatically or in response to a signal from the surface), the collected solid particles are flushed through flush outlets 26A and/or 26B, respectively. Upstream separation system 20A can be configurated to filter out a certain size of particles from the drilling fluid, while downstream separation system 20B can be configured to filter out a smaller particle size from the drilling fluid than upstream separation system 20A.

As used herein, "media" means any liquid or compressible gas, which may include solid particles.

As used herein, "fluid" means any liquid or gas, which may include solid particles.

As used herein, "open" in reference to an outlet, port, or other opening means that fluid communication is open across the outlet, port, or other opening.

As used herein, "closed" in reference to an outlet, port, or other opening means that fluid communication does not exist across the outlet, port, or other opening.

Except as otherwise described or illustrated, each of the components in this device has a generally cylindrical shape and may be formed of steel, another metal, or any other durable material. Portions of separation system 20 may be formed of a wear resistant material, such as tungsten carbide, ceramics, or ceramic coated steel.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. "Plurality" means two or more. "Above" and "below" shall each be construed to mean upstream and downstream, such that the directional orientation of the device is not limited to a vertical arrangement.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A downhole separation system, comprising:

a housing including a housing inner bore and one or more flush outlets extending radially from the housing inner bore to an outer surface of the housing;

a screen disposed within the housing inner bore, the screen including a plurality of openings; wherein a filter flow path within the housing extends through a collection cavity leading to the plurality of openings of the screen for filtering at least a portion of any solids contained in a media flowing through the filter flow path; wherein a flush flow path within the housing extends through the collection cavity and to the one or more flush outlets for flushing at least a portion of the filtered solids through the one or more flush outlets and beyond the outer surface of the housing when the media flows through the flush flow path;

an activation mechanism configured to move within the housing inner bore between a default position and an activated position;

a spring disposed within the housing inner bore, the spring configured to bias the activation mechanism toward the default position; and a dampening mechanism including a fluid passage connecting two dampening chambers, wherein the activation mechanism is configured to force a volume of a fluid from one dampening chamber to flow through the fluid passage and into the other dampening chamber as the activation mechanism moves between the default position and the activated position, and wherein the fluid flow through the fluid passage controls the rate at which the activation mechanism moves between the default position and the activated position;

wherein in the default position the activation mechanism is configured to close the one or more flush outlets and to direct the media flowing into the housing inner bore through the filter flow path; and wherein in the activated position the activation mechanism is configured to open the one or more flush outlets and to direct the media flowing into the housing inner bore through the flush flow path.

2. The downhole separation system of claim 1, wherein the fluid passage includes one or more nozzles.

3. The downhole separation system of claim 1, wherein the fluid passage includes an annular space.

4. The downhole separation system of claim 1, further comprising an outer valve sleeve stationarily disposed within the housing inner bore, the outer valve sleeve comprising a central bore and one or more sleeve ports extending radially from the central bore to an outer surface of the outer valve sleeve; wherein a flush outlet cavity is formed between the outer surface of the outer valve sleeve and the housing inner bore; and wherein the flush outlet cavity fluidly connects the one or more sleeve ports to the one or more flush outlets of the housing.

5. The downhole separation system of claim 4, wherein the one or more sleeve ports and the one or more flush outlets are separated by an axial distance.

6. The downhole separation system of claim 4, wherein the activation mechanism includes an inner valve sleeve that is slidingly disposed within the central bore of the outer valve sleeve; wherein in the default position the inner valve sleeve closes the one or more sleeve ports; wherein in the activated position the inner valve sleeve opens the one or more sleeve ports.

7. A method of filtering a media flowing in a wellbore, comprising the steps of:

a) providing a first separation system comprising: a housing including a housing inner bore and one or more flush outlets extending radially from the housing inner bore to an outer surface of the housing; a screen disposed within the housing inner bore, the screen including a plurality of openings; wherein a filter flow path within the housing extends through the plurality of openings of the screen; wherein a flush flow path within the housing extends to the one or more flush outlets; an activation mechanism configured to move within the housing inner bore between a default position and an activated position; wherein the activation mechanism is configured to close the one or more flush outlets in the default position and to open the one or more flush outlets in the activated position; and a dampening mechanism including a fluid passage connecting two dampening chambers, wherein the activation mechanism is configured to force a volume of a fluid from one dampening chamber to flow through the fluid passage and into the other dampening chamber as the activation mechanism moves between the default position and the activated position;

b) positioning the first separation system in a drill string or a coiled tubing string within a wellbore;

c) flowing the media through the drill string or the coiled tubing string and into the housing inner bore of the first separation system;

d) filtering at least a portion of any solids contained in the media when the activation mechanism is in the default position by directing the media through the filter flow path within the housing; wherein the filtered solids are retained in a collection cavity;

e) activating the first separation system to move the activation mechanism into the activated position to direct the media through the flush flow path for flushing at least a portion of the filtered solids from the collection cavity through the one or more flush outlets beyond the outer surface of the housing and into an annulus surrounding the housing.

8. The method of claim 7, wherein in step (e) the first separation system is activated in response to a signal from the surface of the wellbore.

9. The method of claim 7, wherein in step (e) the first separation system is automatically activated in response to an automatic trigger.

10. The method of claim 7, further comprising the step of:

f) deactivating the first separation system to slidingly return the activation mechanism to the default position to filter the media flowing through the housing inner bore;

wherein steps (b) through (f) are conducted without removing the first separation system from the wellbore.

11. The method of claim 10, wherein in step (e) the first separation system is activated by adjusting a flow rate of the media through the first separation system;

wherein in step (f) the first separation system is deactivated by adjusting a pressure differential between the housing inner bore and the annulus.

12. The method of claim 7, wherein in step (e) a fluid flow through the fluid passage connecting the two dampening chambers controls the rate at which the activation mechanism moves into the activated position.

13. The method of claim 7, wherein step (a) further comprises providing a second separation system comprising: a housing including a housing inner bore and one or more flush outlets extending radially from the housing inner bore to an outer surface of the housing; a screen disposed within the housing inner bore, the screen including a plurality of openings, wherein the plurality of openings of the second separation system are configured to filter a smaller particle size than the plurality of openings of the first separation system; wherein a filter flow path within the housing extends through the plurality of openings of the screen;

wherein a flush flow path within the housing extends to the one or more flush outlets; and an activation mechanism configured to move within the housing inner bore between a default position and an activated position; wherein the activation mechanism is configured to close the one or more flush outlets in the default position and to open the one or more flush outlets in the activated position; wherein step (b) further comprises positioning the second separation system downstream of the first separation system in the drill string or the coiled tubing string within the wellbore; wherein step (c) further comprises flowing the media through the housing inner bore of the second separation system; and wherein step (d) further comprises filtering at least a portion of any solids contained in the media when the second activation mechanism is in the default position, wherein the solids filtered by the second activation mechanism are smaller than the solids filtered by the first activation mechanism.

* * * * *